US008347535B2

(12) United States Patent
Cohlmia

(10) Patent No.: US 8,347,535 B2
(45) Date of Patent: Jan. 8, 2013

(54) DISPLAY AND METHOD OF MAKING THEREOF

(76) Inventor: Thomas L. Cohlmia, Wichita, KS (US)

( * ) Notice: Subject to any disclaimer, the term of this patent is extended or adjusted under 35 U.S.C. 154(b) by 959 days.

(21) Appl. No.: 11/335,853

(22) Filed: Jan. 19, 2006

(65) Prior Publication Data

US 2006/0185202 A1 Aug. 24, 2006

Related U.S. Application Data

(60) Provisional application No. 60/645,132, filed on Jan. 20, 2005.

(51) Int. Cl.
*G09F 19/14* (2006.01)

(52) U.S. Cl. ..... 40/453

(58) Field of Classification Search ..... 40/453; 446/105, 118, 147, 491, 107; 434/81, 176, 434/365

See application file for complete search history.

(56) References Cited

U.S. PATENT DOCUMENTS

| | | | | |
|---|---|---|---|---|
| 4,430,825 | A * | 2/1984 | Leboeuf | 446/101 |
| 4,770,945 | A | 9/1988 | Wachspress | 428/542.2 |
| 5,436,038 | A | 7/1995 | Gelb | 428/13 |
| 6,634,644 | B2 | 10/2003 | Falana | 273/272 |
| 6,769,783 | B2 | 8/2004 | Huang | 362/125 |
| 7,086,187 | B2 * | 8/2006 | Bandak | 40/453 |

* cited by examiner

*Primary Examiner* — Lesley D. Morris
*Assistant Examiner* — Shin Kim
(74) *Attorney, Agent, or Firm* — Cook Alex Ltd.

(57) ABSTRACT

The present invention provides a display and method of making thereof that can comprise comprising fragmenting a first image into a plurality of individual first image fragments, fragmenting a second image into a plurality of individual second image fragments, and positioning the first image fragments and the second image fragments at locations and at orientations in a three dimensional space to form a display having the first image visible when the display is viewed in one direction, the second image visible when the display is viewed in a different direction, and neither the first image nor the second image visible when the display is viewed in other directions. The invention also envisions a kit for making a display and a method for making an advertisement where two images can be viewed from two directions and not from any other direction.

45 Claims, 20 Drawing Sheets

| Piece number | WORK horiz. length (A) | PLAY horiz. length (B) | Height (H) | Total Length (L) $L^2=A^2+B^2+H^2$ | θ (deg) θ=asin(H/L) | φ (deg) φ=atan(B/A) |
|---|---|---|---|---|---|---|
| 1 | 0.5 | 0 | 2 | 2.06 | 75.96 | 0.00 |
| 2 | 1 | 1.5 | 4 | 4.39 | 65.74 | 56.31 |
| 3 | 1 | 0 | 4 | 4.12 | 75.96 | 0.00 |
| 4 | 1 | 0 | 4 | 4.12 | 75.96 | 0.00 |
| 5 | 0 | 0 | 4 | 4.00 | 90.00 | 90.00 |
| 6 | 3 | 3 | 0 | 4.24 | 0.00 | 45.00 |
| 7 | 0 | 1.5 | 4 | 4.27 | 69.44 | 90.00 |
| 8 | 3 | 3 | 0 | 4.24 | 0.00 | 45.00 |
| 9 | 0 | 1.5 | 2 | 2.50 | 53.13 | 90.00 |
| 10 | 3 | 3 | 0 | 4.24 | 0.00 | 45.00 |
| 11 | 0 | 0 | 2 | 2.00 | 90.00 | 90.00 |
| 12 | 3 | 0 | 2 | 3.61 | 33.69 | 0.00 |
| 13 | 3 | 3 | 0 | 4.24 | 0.00 | 45.00 |
| 14 | 0 | 1.5 | 4 | 4.27 | 69.44 | 90.00 |
| 15 | 3 | 1.5 | 2 | 3.91 | 30.81 | 26.57 |
| 16 | 3 | 0 | 2 | 3.61 | 33.69 | 0.00 |
| 17 | 0 | 0 | 2 | 2.00 | 90.00 | 90.00 |
| 18 | 0.5 | 0 | 2 | 2.06 | 75.96 | 0.00 |

| Piece Number | WORK (X) coordinate | PLAY (Y) coordinate | Height (Z) coordinate | Length $L^2=\Delta X^2+\Delta Y^2+\Delta Z^2$ | θ (deg) $\theta=\text{asin}(\Delta Z/L)$ |
|---|---|---|---|---|---|
| 1 | -7 | -7 | 0 | 2.06 | 75.96 |
| | -7.5 | -7 | 2 | | |
| 2 | -7 | 1 | 0 | 4.39 | 65.74 |
| | -6 | 2.5 | 4 | | |
| 3 | -5 | -3 | 0 | 4.12 | 75.96 |
| | -6 | -3 | 4 | | |
| 4 | -5 | -7 | 0 | 4.12 | 75.96 |
| | -4 | -7 | 4 | | |
| 5 | -3 | -7 | 0 | 4.00 | 90.00 |
| | -3 | -7 | 4 | | |
| 6 | -3 | -7 | 4 | 4.24 | 0.00 |
| | 0 | -4 | 4 | | |
| 7 | 0 | 1 | 0 | 4.27 | 69.44 |
| | 0 | 2.5 | 4 | | |
| 8 | -3 | -3 | 0 | 4.24 | 0.00 |
| | 0 | 0 | 0 | | |
| 9 | 1 | 6 | 2 | 2.50 | 53.13 |
| | 1 | 4.5 | 4 | | |
| 10 | 1 | -7 | 4 | 4.24 | 0.00 |
| | 4 | -4 | 4 | | |
| 11 | 4 | -3 | 2 | 2.00 | 90.00 |
| | 4 | -3 | 4 | | |
| 12 | 4 | 6 | 0 | 3.61 | 33.69 |
| | 1 | 6 | 2 | | |
| 13 | 1 | -7 | 2 | 4.24 | 0.00 |
| | 4 | -4 | 2 | | |
| 14 | 5 | 4 | 0 | 4.27 | 69.44 |
| | 5 | 2.5 | 4 | | |
| 15 | 5 | 6 | 2 | 3.20 | 38.66 |
| | 7 | 7.5 | 4 | | |
| 16 | 8 | -3 | 0 | 3.61 | 33.69 |
| | 5 | -3 | 2 | | |
| 17 | 1 | -7 | 0 | 2.00 | 90.00 |
| | 1 | -7 | 2 | | |
| 18 | -7.5 | -4 | 2 | 2.06 | 75.96 |
| | -8 | -4 | 4 | | |

Figure 7B

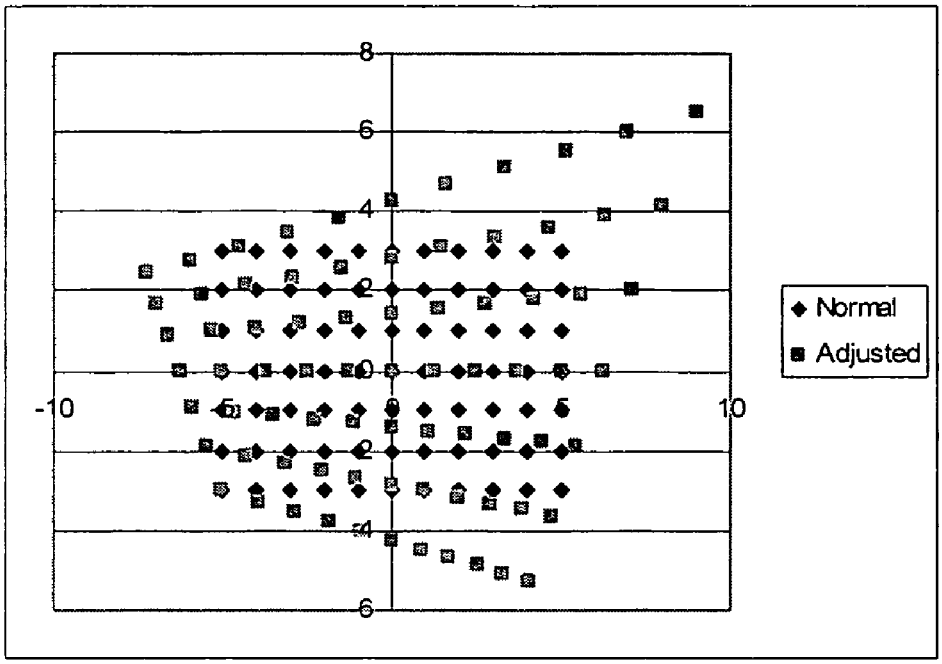

Figure 8F

```
xview = input('What is the viewing distance along the x-coordinates?:  ');
yview = input('What is the viewing distance along the y-coordinates?:  ');

g = input('Input the points, in two column matrix form (X,Y):  ')

points = length(g)
for j = 1:points
    x = g(j, 1)
    y = g(j, 2)
% This code uses the point-slope equations of the two lines to solve for x
x = (y + yview)/((yview/x)-(x/xview));
%This code uses the found x-value and one of the point-slope equations to find y
    y = (y/xview)*x+y;
%This code converts the x and y values back into complex form in a new vector, h
    h(j, 1) = x;
    h(j, 2) = y
end
tot = [g, h]
```

Figure 8G

| Piece Number | WORK (X) coordinate | PLAY (Y) coordinate | Height (Z) coordinate | Length $L^2=\Delta X^2+\Delta Y^2+\Delta Z^2$ | θ (deg) $\theta=\text{asin}(\Delta Z/L)$ |
|---|---|---|---|---|---|
| 1 | -8.1951 | 5.8049 | 0 | 2.09 | 72.77 |
| | -8.8088 | 5.7154 | 2 | | |
| 2 | -7.0031 | -0.8541 | 0 | 4.39 | 65.54 |
| | -5.7778 | -2.1991 | 4 | | |
| 3 | -5.3708 | 2.6643 | 0 | 4.15 | 74.52 |
| | -6.4762 | 2.5952 | 4 | | |
| 4 | -5.792 | 6.1553 | 0 | 4.17 | 73.44 |
| | -4.6154 | 6.3269 | 4 | | |
| 5 | -3.451 | 6.4967 | 0 | 4.00 | 90.00 |
| | -3.451 | 6.4967 | 4 | | |
| 6 | -3.451 | 6.4967 | 4 | 4.26 | 0.00 |
| | 0 | 4 | 4 | | |
| 7 | 0 | -1 | 0 | 4.27 | 69.44 |
| | 0 | -2.5 | 4 | | |
| 8 | -3.2 | 2.8 | 0 | 4.25 | 0.00 |
| | 0 | 0 | 0 | | |
| 9 | 0.87538 | -6.1094 | 2 | 2.51 | 52.68 |
| | 0.90664 | -4.585 | 4 | | |
| 10 | 1.1463 | 7.1672 | 4 | 4.27 | 0.00 |
| | 4.3636 | 4.3636 | 4 | | |
| 11 | 4.2797 | 3.2675 | 2 | 2.00 | 90.00 |
| | 4.2797 | 3.2675 | 4 | | |
| 12 | 3.5245 | -6.4406 | 0 | 3.34 | 36.84 |
| | 0.87538 | -6.1094 | 2 | | |
| 13 | 1.1463 | 7.1672 | 2 | 4.27 | 0.00 |
| | 4.3636 | 4.3636 | 2 | | |
| 14 | 4.6336 | -4.3861 | 0 | 4.32 | 67.66 |
| | 4.7916 | -2.7496 | 4 | | |
| 15 | 4.423 | -6.5529 | 2 | 3.19 | 38.84 |
| | 6.0346 | -8.4429 | 4 | | |
| 16 | 8.7429 | 3.5464 | 0 | 3.93 | 30.62 |
| | 5.3708 | 3.3357 | 2 | | |
| 17 | 1.1463 | 7.1672 | 0 | 2.00 | 90.00 |
| | 1.1463 | 7.1672 | 2 | | |
| 18 | -8.3283 | 3.306 | 2 | 2.08 | 73.62 |

Figure 8H

DISPLAY AND METHOD OF MAKING THEREOF

This application claims benefits and priority of provisional application Ser. No. 60/645,132 filed Jan. 20, 2005.

FIELD OF THE INVENTION

The present invention relates to a display, and more specifically, to a three dimensional display that can reveal two images when viewed from two different directions, but not in other directions.

BACKGROUND OF THE INVENTION

Displays often use one or more shapes, figures, symbols, alphanumeric characters, and the like to convey a message or advertisement. The present invention advantageously provides a display and method of making a display such that the display can reveal two images when viewed from two different directions but not in other directions.

Kits for making three dimensional models can provide both enjoyment and an intellectual challenge for the user. The invention can advantageously provide a kit for making a display of the type described in the preceding paragraph.

SUMMARY OF THE INVENTION

The present invention provides a method of making a display comprising fragmenting a first image into a plurality of individual first image fragments, fragmenting a second image into a plurality of individual second image fragments, and positioning the first image fragments and the second image fragments at locations and at orientations in a three dimensional space to form a display having the first image visible when the display is viewed in one direction, the second image visible when the display is viewed in a different direction, and neither the first image nor the second image visible when the display is viewed in other directions.

In an embodiment of the invention the positioning step can further include positioning an individual first image fragment to form part of the second image, positioning an individual second image fragment to form part of the first image, positioning an individual first image fragment so as to hide behind an individual second image fragment, and/or positioning an individual second image fragment so as to hide behind an individual first image fragment.

The positioning step can be achieved by determining the location of each individual fragment in the display, determining the length and orientation angle of each individual fragment in the display, and placing the fragment in the display according to the location, length, and angle. In another embodiment the positioning step can be achieved by using a coordinate subsystem, such as a spherical coordinate subsystem or a system based on cubes that collectively form the three dimensional space of the display. In still another embodiment, the positioning step can be achieved by using a Cartesian system. The Cartesian system can have a first image along a first axis and a second image along a second axis and can have a third axis for the height of the first and second images. Another embodiment involves a positioning step that can be achieved by positioning one or more first image fragments on one or more support bodies so as to be visible, positioning one or more second image fragments on one or more support bodies so as to be visible, and position the support bodies to form the display.

Another embodiment of the method of making a display further comprises adjusting the position of the individual fragment to improve focal alignment, securing the fragments on support members disposed on a base, and/or disposing the fragments on suspended support strands.

In still yet another embodiment, the method for making a display can comprise projecting a first image and a second image into a three dimensional space to be occupied by the display so that the first image and the second image intersect in the space, and removing portions from the projecting first and second images until a minimum number of fragments remains to form the first and second images in the display as described above. This embodiment can further include fragmenting the first image and second image into a plurality of first and second image fragments and positioning the first image fragments and second image fragments to form the first and second images.

Another embodiment of a method of making a display can comprise fragmenting a first image into a plurality of first image fragments, fragmenting a second image into a plurality of second image fragments, projecting the first image and the second image into a three dimensional space to be occupied by the display so that the first image and the second image intersect in the space and provide fragment locations in the space where the first image fragments and the second image fragments will reside, and positioning the first image fragments and second image fragments at the locations and at orientations in the space to form a display having the first image visible when the display is viewed in one direction, the second image visible when the display is viewed in a different direction, and neither the first image nor the second image visible when the display is viewed in other directions. The embodiment can further comprise removing fragments from the projecting first and second image until the minimum number of fragments remains to form the first and second images.

The invention also envisions a display, comprising a plurality of first image fragments of a first image and a plurality of second image fragments of a second image wherein the first image fragments and second fragments are disposed at such spaced apart fragment locations in a three dimensional space that the first image is visible when the display is viewed in one direction, the second image is visible when the display is viewed in a different direction, and neither the first image nor the second image is visible when the display is viewed in other directions. The first and second images can each comprise a word, shape, symbol, figure, alphanumeric image, slogan, name, corporate name, logo, trademark, service mark, uniform resource locator (hereinafter URL), domain name, or combinations thereof.

In another display embodiment, support members can be provided for positioning the first and second image fragments in the display. The support members can comprise support wires disposed on a base or suspended support strands.

Another display embodiment provides that an individual first image fragment can form part of the second image, an individual second image fragment can form part of the first image, an individual first image fragment can be hidden behind an individual second image fragment, and/or an individual second image fragment can be hidden behind an individual first image fragment.

Another embodiment of the display can further include a light source for impinging light on the display.

In still another embodiment, one or more first or second image fragments reside on one or more support bodies so as to be visible. The support bodies can be stacked, positioned side-by-side, or otherwise positioned to form the display.

The invention also envisions a kit for making a three dimensional display comprising a plurality of fragments of a first image fragments of a first image, a plurality of second image fragments of a second image, a plurality of support members on which the first and second image fragments are positioned, and instructions for arranging the first and second image fragments until the display is formed having the first image visible when the display is viewed in one direction, the second image visible when the display is viewed in a different direction, and neither the first image nor the second image visible when the display is viewed in other directions.

The invention can also embody a method of displaying an advertisement comprising providing an advertising display having a first and second image where the first image is visible when the display is viewed in one direction, the second image is visible when the display is viewed in a different direction, and neither the first image nor the second image visible when the display is viewed in other directions, and positioning the advertising display at a location where the public can view the display in a plurality of directions that include said one direction and said different direction. The first and second images can each comprise a word, shape, symbol, figure, alphanumeric image, slogan, name, corporate name, logo, trademark, service mark, URL, domain name, or combinations thereof.

DESCRIPTION OF FIGURES

FIGS. 1A and 1B are side views showing each of the images "angel" and "devil. " FIG. 1C is a perspective view of the angel-devil display.

FIG. 3A shows how both words have been extruded together. After removing portions of the extruded images, FIG. 3B illustrates that only the intersections of both extruded words remain. FIG. 3C is an example showing that any one letter, here "R", from the word "work" can display the entire second word, "play. " FIG. 3D shows that each letter of "work" can display a letter of "play." Fragmented words "work" and "play" are shown in FIG. 3E.

FIG. 4A shows the two words having the same height. The word "work" is fragmented and numbered in FIG. 4B. The fragments having the same vertical extremes as fragment 1 are dashed lines in FIG. 4C. FIG. 4D shows how fragments are matched and FIG. 4E shows how fragments can be overlapped. New fragments can be created as shown in FIG. 4F. FIG. 4G shows that any gaps in the words can be filled. FIG. 4H shows the fragments that are not necessary to display the word "play" but are still needed for the word "work. The final plan of the work-play design is shown in FIG. 4I.

FIG. 6B is a table showing the dimensions of work-play display fragments calculated using the coordinate subsystem method.

FIGS. 7A-7C are used for the Cartesian system method. FIG. 7A illustrates the Cartesian coordinates of the work-play example. FIG. 7B is a table showing calculations using the fragments' coordinates to determine length and θ. FIG. 7C is a top view of the fragments' coordinates.

FIGS. 8A-8I illustrate focal alignment of the work-play example. FIG. 8A is a side view of the word "work" that is not focally aligned. FIG. 8B is a diagrammatic view of an angled grid that can be used in focal alignment. FIG. 8C is a grid showing the position of an unadjusted point being viewed from 48 inches in the x and y planes. FIG. 8D is a grid showing the position of the adjusted point from FIG. 8C. FIG. 8E is a closer look at the alignment of the points shown in FIGS. 8C and 8D showing the original and the adjusted points. FIG. 8F is a grid showing the normal points and the adjusted points. FIG. 8G is an example of MATLAB code for focal alignment. FIG. 8H is a table that provides adjusted points for the work-play example shown in FIG. 7B. FIG. 8I is the final plan of the work-play example after being focally aligned.

FIG. 10A shows the location of the fragments' endpoints as dots in a grid when viewed from the top of the display. FIG. 10B is a perspective view of the display showing the top plate T, bottom plate M, openings P, and suspended support members S. FIG. 10C is a side view of a fragment F prior to positioning on the suspended support members S. FIG. 10D is a perspective view of the suspended fragments F, weights WT, earring clutches C, suspended support members S, top plate T, and bottom plate M in an assembled suspended embodiment.

DETAILED DESCRIPTION OF INVENTION

The invention provides a display and a method of making a display that reveals two images, but only when the images are viewed from two specific locations. This is accomplished by the careful alignment of many image fragments, which are created with specific dimensions and locations so that they form the desired images. There are many methods that can be employed to build this display and several illustrative methods are described herein for purposes of illustration and not limitation.

Figure 1A:
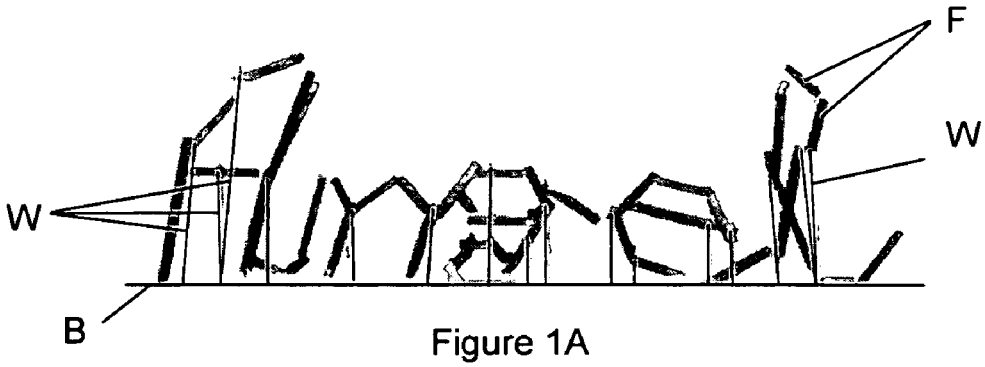
FIGS. 1A, 1B, and 1C show an angel-devil display pursuant to an embodiment of the invention.
Figure 1B:
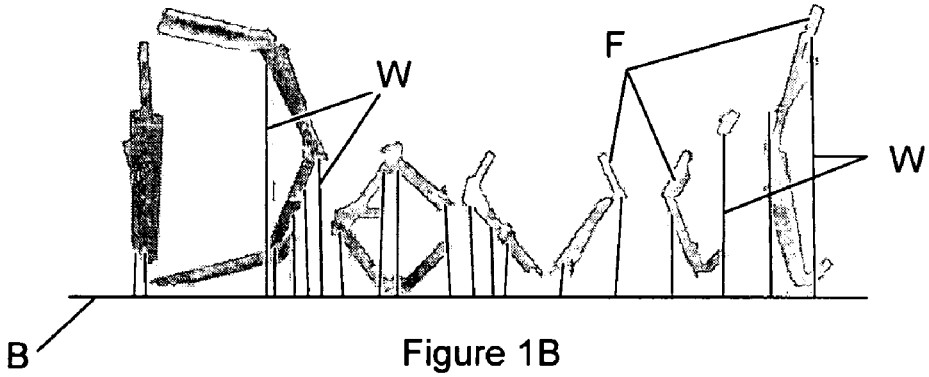
Figure 1C:
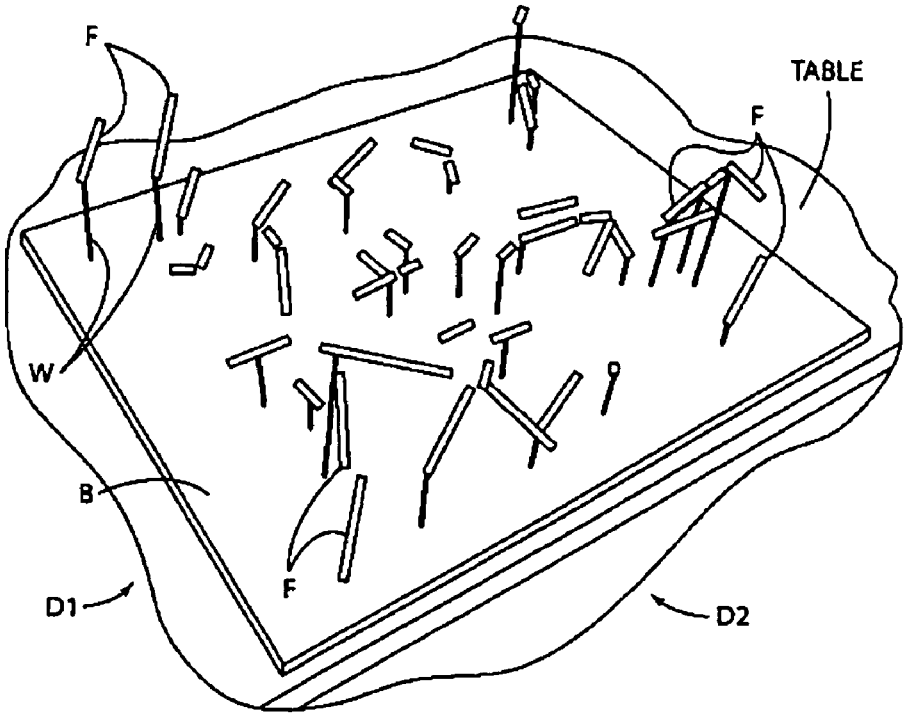

FIGS. 1A, 1B, and 1C show an example of a display pursuant to an embodiment of the invention, which reveals the word "Angel" when viewed from direction D1 and the word "Devil" from direction D2. The two words are not visible when the display is viewed in other directions. The angel-devil display comprises a base B and support wires W with image fragments F on the support wires W to form the display. Some of the support wires W are shown in FIGS. 1A-1C, but not all are shown for convenience. The support wires W maintain the position of the fragments on the base B. The base B of the angle-devil display is shown disposed on a Table in FIG. 1C.

An embodiment of the invention is described below for illustration and not limitation using the words "work" and "play" as the two images in a display. The two words can first be equated in one dimension, for example, equating the heights of the two words. In constructing a display, the invention thus employs a rotational constant dimension. The rotational constant dimension is the dimension of any object rotated about an axis that does not appear to change as the object rotates, namely the dimension along that rotational axis. For example, the rotation of an object can have many different outlines and lengths, but the vertical height from the top to bottom can remain the same.

Figure 2:
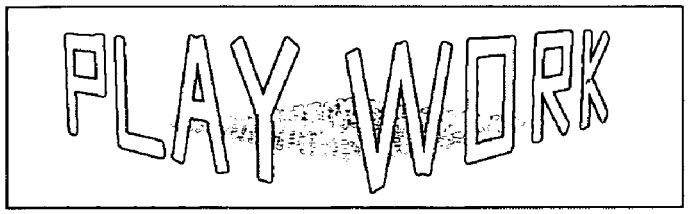
FIG. 2 is a perspective view of the work-play display where the words "work" and "play" have the same height.
Figure 3A:
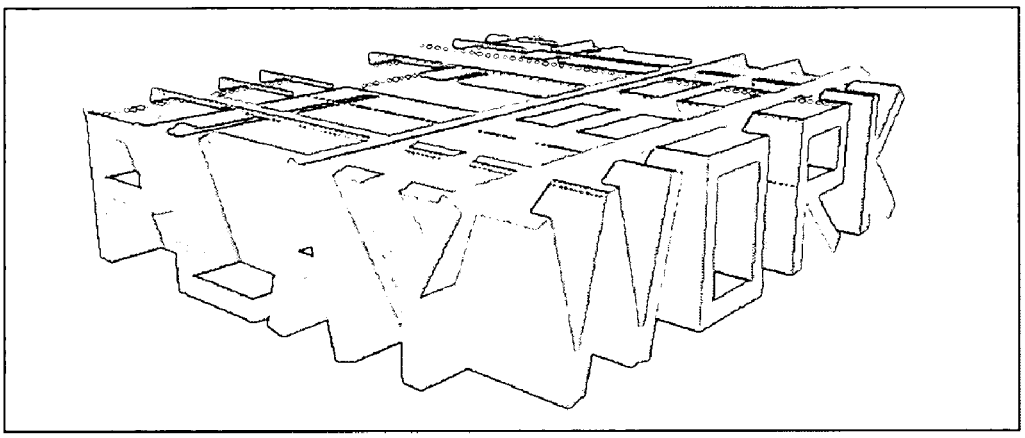
FIGS. 3A-3E are perspective views of the work-play display.

FIG. 2 shows "work" and "play" having the same height. At this point, a display can be created by merging "work" and "play" together. This merging can be accomplished visually by extruding them together into a block as shown in FIG. 3A where the "work" and "play" images are projected into the three dimensional space to be occupied by the display. The merged "work" and "play" images intersect in space and provide fragment locations for the first and second image fragments.

Figure 3B:
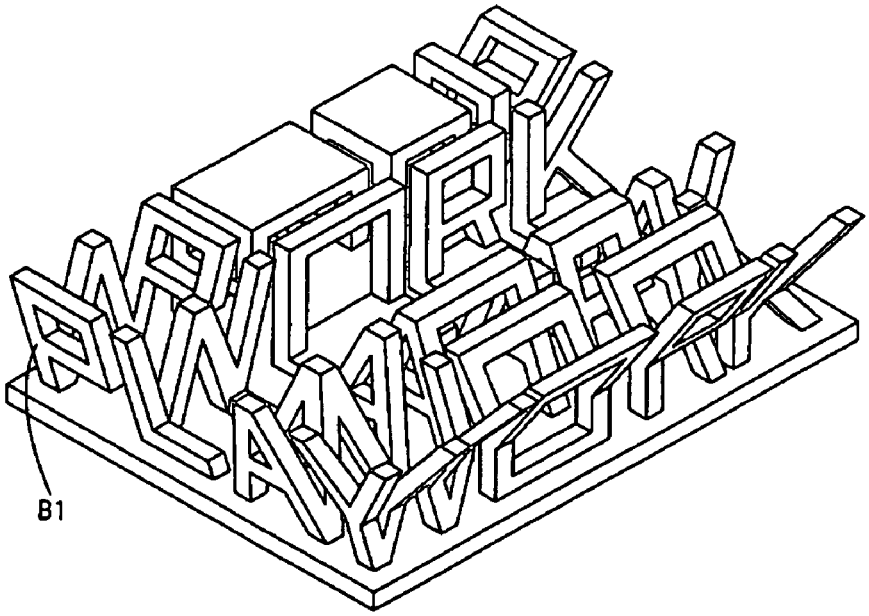

In this embodiment, portions are removed from the projected first and second image until the minimum number of fragments remains to form the first and second images in the display. FIG. 3B shows that only the intersections of both extruded words remain. Upon close inspection, it can be seen that the two words are spelled out in the remaining intersecting extrusions.

Figure 3C:
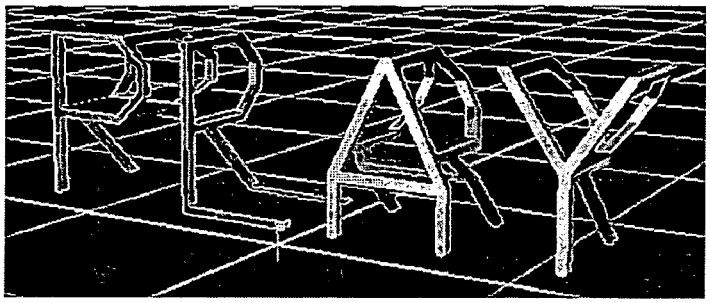
Figure 3D:
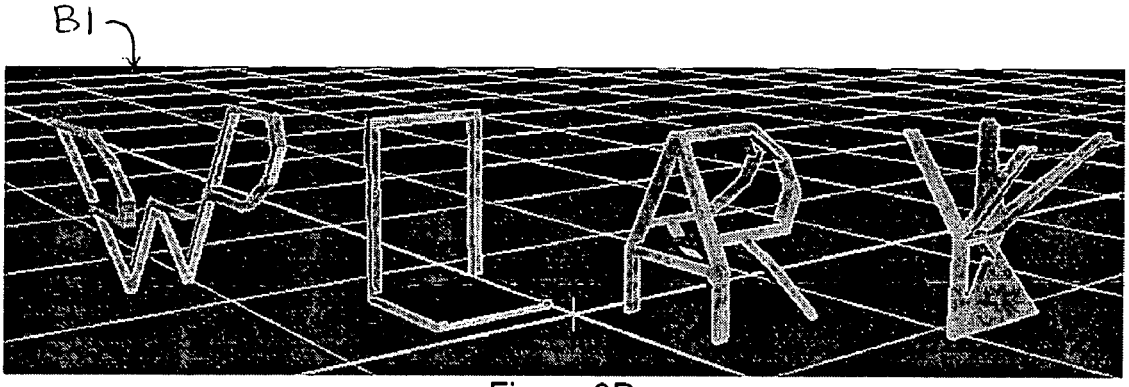

By looking at FIG. 3B, it is easy to see that not all of these image fragments shown are necessary, where each "block" B1 is the intersecting, merged letters. For example, any one letter from the first word and can spell the entire second word from its extrusions. The extruded "R" from "work" shown in FIG. 3C spells the entire word "play." However, this does not show complete words of both "work" and "play". To show both words simultaneously as in FIG. 3D, one block for each letter can be chosen to dramatically reduce the redundancy shown in FIG. 3B. FIG. 3D shows how the first letter of "work" can be merged with the first letter of "play" to form block B1 and so on. This is a simple method of making and form of the display of the invention.

However, the display can be broken up further into smaller fragments and made more complex. An embodiment of the invention provides a method of making a display comprising fragmenting a first image into a plurality of individual first image fragments, fragmenting a second image into a plurality of individual second image fragments, and positioning the first image fragments and the second image fragments at locations and at orientations in a three dimensional space to form a display having the first image visible when the display is viewed in one direction, the second image visible when the display is viewed in a different direction, and neither the first image nor the second image visible when the display is viewed in other directions.

Figure 3E:
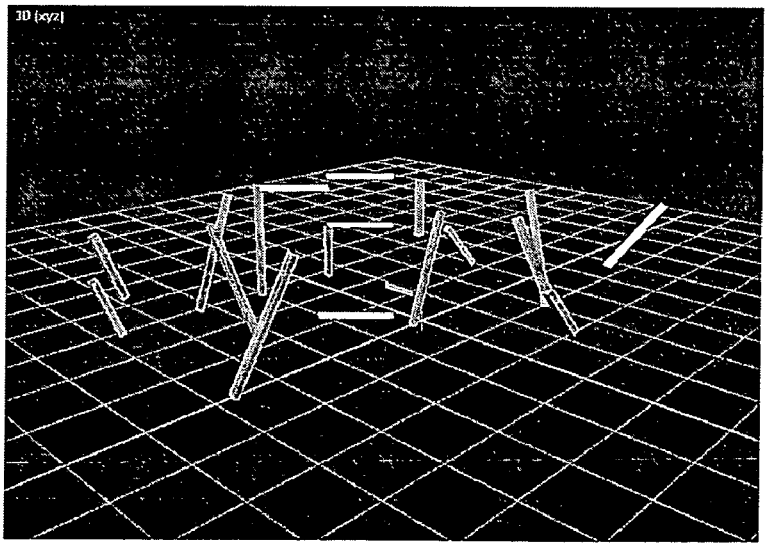

For example, the work-play display is again used to illustrate this embodiment. FIG. 3B shows the basis for the display because it contains every possible fragment location, while still spelling both words. To create a display, the material is removed from the framework of FIG. 3B until removal will delete part of one of the "work" or "play" images. Entire blocks from FIG. 3B are not removed, instead only parts of the intersecting images are removed to leave fragments of each image. Thus, "work" and "play" have been fragmented into a plurality of individual fragments. One example of the fragmented work-play display is shown in FIG. 3E.

A computer-aided design (CAD) or other suitable software program can be used as a conventional way of fragmenting the images, particularly if the images involve unusual shapes and curves. The entire display can be designed this way, and then sent to a parts manufacturer that can take the CAD drawing and produce the image fragments for assembly.

The program can be designed for fragmenting the two images chosen as the two "views" of the display. The images can be resized by the software so that images are the same height. The software can then fragment the images at joints or at selected locations and automatically number these fragments such as left to right, and top to bottom on one of the images. The software can match each first image fragment to a second image fragment having the same vertical extremes i.e. the maximum and minimum z-coordinates of one fragment are the same as the other and the matching fragment on the second image can be assigned the same number as its mate. To simplify the process, all fragments of the same vertical extremes can be matched at the same time, to prevent redundant searching of heights. The software can assign multiple fragments on one image to a single fragment on the other image if necessary.

When all fragments that have matching vertical extremes have been assigned to each other, the software must find any unassigned gaps in the second image and determine if any leftover fragments from the first image can be used to fill part or all of the gaps. Further fragmentation may occur to fit the outline of the image or to create more fragments for filling any gaps. The software can determine if there are extra fragments of an image that may need to be hidden behind the outline of the other image.

Nevertheless, it is not actually necessary to use these advanced graphics and manufacturing tools to design a display pursuant to the invention. The actual design and fragmentation can easily be done using manual calculations using nothing more than an ordinary pencil and paper, with a scientific calculator for the calculations. To illustrate this method of fragmentation, the work-play display of FIG. 3E can be manually generated as shown in FIGS. 4A-4I and is described below.

Figure 4A:
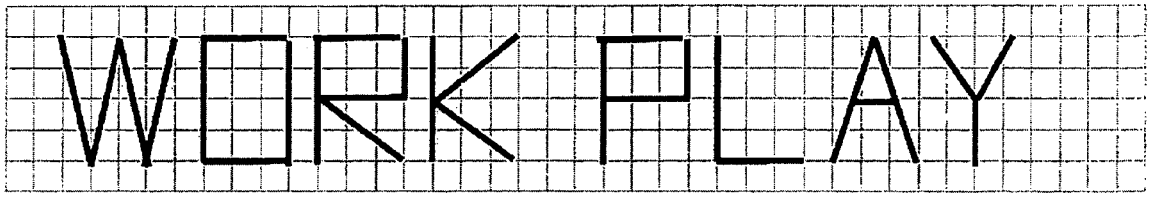
FIGS. 4A-4I are diagrammatic views of the manual steps for fragmenting the work-play display example.
Figure 4B:
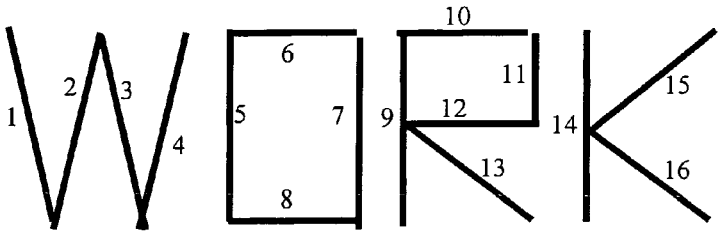

First the two images are created and carefully drawn to the same height as shown in FIG. 4A. Graph paper can be used, but is not necessary. Then the two images are fragmented into individual lines, based on the preference of the creator. In this example, each line is used as a single fragment. Then the fragments of one image are numbered as the "work" example in FIG. 4B.

Figure 4C:
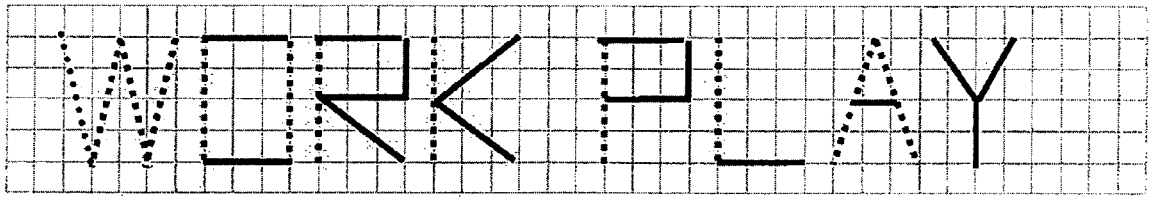
Figure 4D:
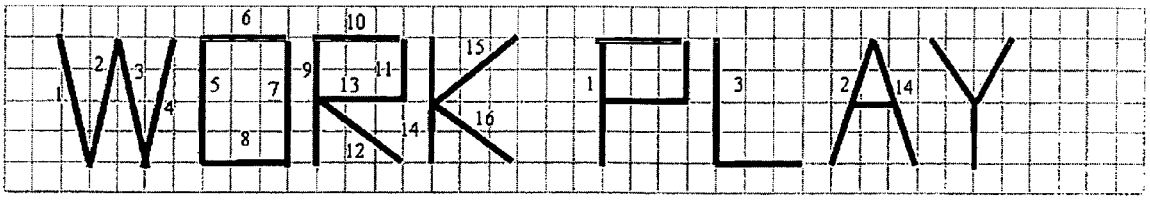
Figure 4E:
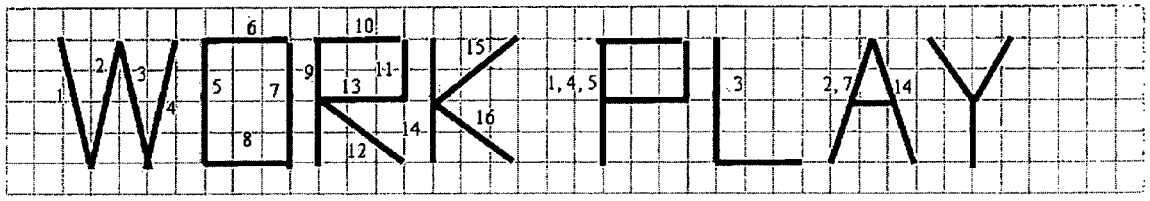

Once this is done, the numbered image fragments must be correlated to fragments in the second image. Essentially, each assigned number will eventually represent a three-dimensional fragment that fits both images. This is done by matching image fragments with the same vertical extremes—that is, the vertical maximum and minimum of the two image fragments is identical. For example, image fragment number 1 on "work" can be matched with any of the image dashed fragments in "play" as shown in FIG. 4C. Thus, fragment 1 can be matched with the dashed line in P, and number it as such. This matching continues until all of the fragments are used, as shown in FIG. 4D. An individual first image fragment can be positioned to form part of the second image and an individual second image fragment can be positioned to form part of the first image.

Unfortunately, there are not enough fragments that have the same vertical extremes. For example, FIG. 4D shows that four fragments 1, 2, 3, and 14 are assigned to "play" and there are no more matches in "play" for fragments of that vertical extreme for the remaining fragments 4, 5, 7, and 9 of "work." This invention has devised several methods to solve this problem.

A simple method for solving this fragmenting problem is to simply assign multiple numbers to the same fragment. For example, fragments 4 and 5 can be assigned to the P, and fragment 7 can be assigned to the left leg of the A. The diagram then looks like FIG. 4E. Physically, this simply means that from one view, these two fragments will be some distance apart, but from the view where multiple fragments are assigned, they will simply line up and not be distinguishable from one another.

Figure 4F:
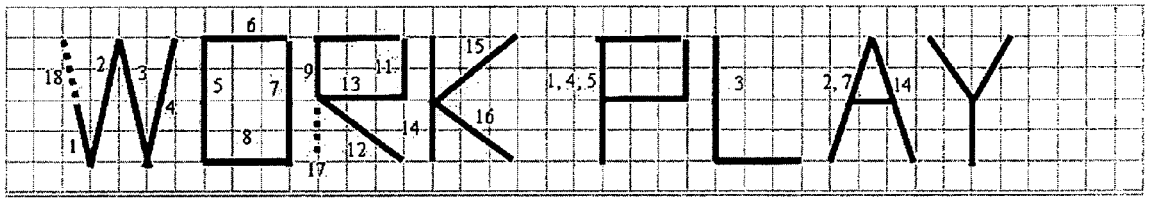

Alternately, the remaining fragments can be fragmented further to create new, smaller fragments. These smaller fragments can then be assigned as necessary. In this example, fragments 1 and 9 are cut in half, creating two new smaller fragments 17, 18 in the process, as seen in FIG. 4F. However, notice that fragment 1 has been assigned to "play," but now it is only half as long. Thus, if fragment 1 were the only fragment assigned to that location, then the P would be incomplete, missing the space occupied by fragment 18. Fortunately, fragments 4 and 5 fill in what in this gap, and fragment 1 merely becomes overshadowed by the other two fragments.

Figure 4G:
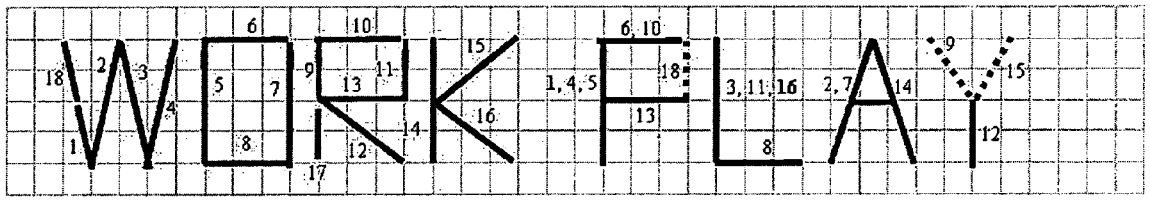
Figure 4H:
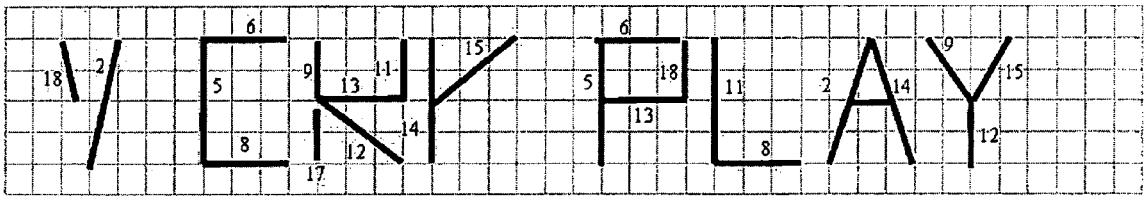

Fragmenting can be done for many reasons. First, as described above, it can distribute excess fragments. Also, it can be used to fill gaps in the display. For example, the dashed fragments in FIG. 4G show that there were originally not enough fragments in "work" having the vertical extremes to fit all the spaces: only fragments 11 and 15 had the correct vertical extremes to fill the three gaps in "play." However, now that fragments 9 and 18 were cut to these dimensions, there are enough fragments to fill the gaps. These fragments, along with the remaining fragments, are labeled in FIG. 4G.

Notice in FIG. 4G that image fragments 16 and 1 (in bold) are not the same dimensions as the fragment they were assigned to in "play": they each only go up half the height of a full-length fragment. This is perfectly acceptable. Think of it not as a fragment that is being used to spell out "play", but instead as an unnecessary image fragment that must "hide" so as not to mar the outline of the word in the display. Thus, creating the display involves conceptualizing that one of the images may "need" a fragment, while the other image may not "need" a fragment. Therefore, with respect to any "doubled up" fragment, i.e. two numbers assigned to the same fragment, one of the number assignments is not necessary to spell out the other word. For example, fragments 1, 4, 3, 7, 10 and 16 can be completely removed, and "play" is complete. While these fragments are necessary for "work," they are useless for "play. Deleting these fragments, as suggested, provides the display shown in FIG. 4H. Notice that "play" is complete; "work", however, is incomplete. In most cases, there will be one image that has more fragments than the other, which will create a great deal of redundancy on the smaller image. Thus, there is a need for fragments that can and do overlap or hide in the display. An individual first image fragment can be positioned so as to hide behind an individual second image fragment and an individual second image fragment can be positioned so as to hide behind an individual first image fragment. Therefore, the fragments 1, 4, 3, 7, 10, and 16 must be kept for the word "work" and are done so by hiding them behind fragments used for the word "play."

Figure 4I:
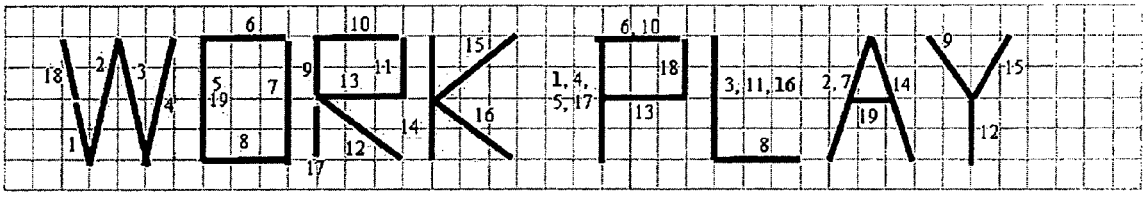

Furthermore, the horizontal line in the letter "A" shown in FIG. 4G has been left unassigned; after running out of fragments in "work", there is still one fragment that has no match. To remedy this, the horizontal line in the letter "A" can be assigned a new fragment number 19 and assigned as described above for all the fragments of "work." Fragments 19 and 13 can be easily matched, but there is no need to be so specific. The horizontal line in the letter "A" of "play" will appear as a dot in the word "work". Therefore, the horizontal line in the letter "A" can be hidden behind a fragment having the same height. For example, fragment 19 is matched to the center fragment 5 in "work," as shown in FIG. 4I, to provide the final fragmentation layout of the work-play display.

To assist in positioning, the display creator can reassign the fragment numbers for one word so that the fragments' numbers increase from left to right and top to bottom.

There are many more methods of fragmenting images that can involve cutting, numbering, and assigning fragments, and the best method depends on the available tools. For example, if manually constructing a display it can be built by fragmenting the images into straight lines. Then the fragments of the first image can be numbered left to right and top to bottom; this is not for any particular reason, but simply because the fragments are easier to find. If the numbering and assigning were done on a computer, it can be done in any order at all.

The method of cutting all fragments into straight lines is simpler to build, because there are no unusually shaped fragments. Unfortunately, this can make matching fragments more difficult; since the fragments are cut at joints, there is no guarantee that the joints on different images will be at the same height. This makes it unlikely that fragments will have the same vertical extremes, so fragments will not align properly and will have to be divided further.

A solution to this problem is to cut not on the joints, but instead to cut at a select few predetermined heights. For example, a display of height X can be made where all cuts are made at heights ⅓ X and ⅔ X. Of course, not all the fragments need to be cut at these heights; only a given percentage of the fragments that cross at this height need to be cut, but this method can provide most fragments having one of several specific dimensions. In this example, most fragments can have vertical extremes at 0, ⅓ X, ⅔ X, and/or X. This method does make construction more difficult, because fragments are no longer simple sticks, but is still workable.

In addition, when assigning fragments of one image to the other, it is easiest to match all fragments of the same vertical extremes at the same time; this saves time because it is easy to recognize all the fragments with the same vertical extremes at once, rather than searching for the same dimensions multiple times.

Figure 5A:
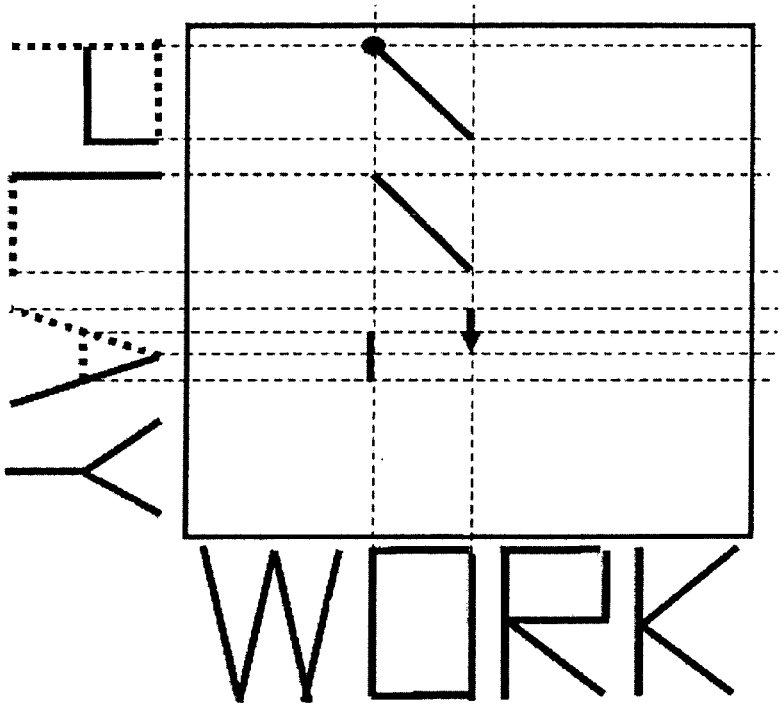
FIGS. 5A and 5B are diagrammatic views showing the fragments as viewed from the top of the display.

The display is now designed and the image fragments must be positioned according to this design. Exemplary methods for determining the fragment positions are now offered for illustration and not limitation using the work-play display. A top view of the display is helpful for determining the exact position of the fragments in the display. The images can be written along the two adjacent edges of a square as shown in FIG. 5A. The square in FIG. 5A represents a top view of the area where the three-dimensional fragments will be located. The fragments can be matched according to their numbers from FIG. 4I and marked on this square.

Figure 5B:
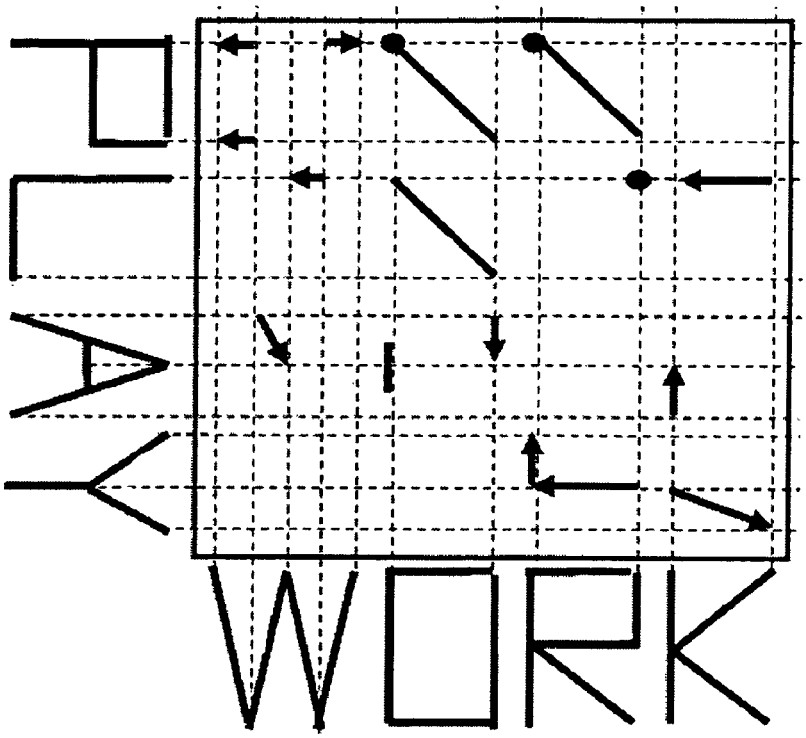

As described above, a fragment can have two separate "faces," one for each resulting image, and can be created from these two faces by merging their dimensions together. This can be done by drawing straight lines from both extremes of each face out into the square, parallel to the sides of the base. When this is done from both faces, the lines intersect to form a box, where the resulting fragment will be located in the display. For example, the "tops" of the two faces must be the same; thus, the intersection of the lines coming from the tops of the two faces represents the top of the final fragment, and the bottoms are found in the same manner. The result looks like FIG. 5A for the letter "O" in "work." The location of the remaining fragments can be determined and drawn onto a grid as shown in FIG. 5B, which is essentially a top view of the work-play display example.

For ease of notation: if the line is an arrow, then the head of the arrow represents the top of the fragment. If there is a circle, it represents a vertical rod, which simply looks like a dot from above. If a fragment is entirely horizontal, then it has no arrow and is simply a line.

Each fragment can be considered a separate entity and needs to be positioned. The positioning step can be achieved by determining the location of each individual fragment in the display, determining the length and orientation angle of each individual fragment in the display, and placing the fragment in the display according to the location, length, and angle. Determining the location, orientation, shape, and size and positioning the fragments can be achieved using various methods.

Two methods are described below and offered for illustration and not limitation. One method, the coordinate subsystem, considers each fragment as a separate entity and describes its dimensions in a certain location. The other method, the Cartesian system, considers the fragments as one large array and describes them as points in this array.

Figure 6A:
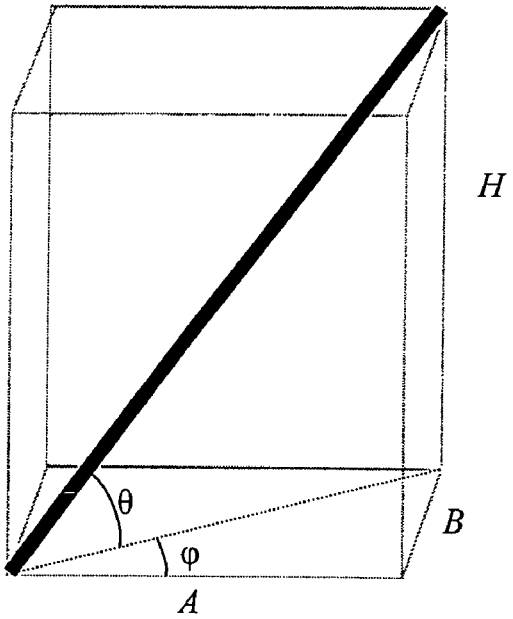
FIG. 6A is a perspective view of a fragment disposed in the imaginary cube that is used in the coordinate subsystem method.

The coordinate subsystem can be a spherical coordinate subsystem or a system based on cubes that collectively form the three dimensional space of the display. Imagine that each fragment of the display is contained within a cube, where the endpoints of the line are at opposite corners of this cube. FIG. 6A shows a hypothetical fragment within a cube. The sides of the cube run parallel and perpendicular to the grid upon which the display is built, and represent the absolute XYZ directions of the display. The dimensions of this box are determined by the two views of the fragment; A represents how "wide" the fragment looks from one view, B represents how wide it looks from the second view, and H represents the height, which, as stated previously, is the same regardless of which image is viewed. For example, as shown in FIG. 4I "work" is A and "play" is B. Fragment 15 in FIG. 4I has a length A that is three grid squares across, length B is 1.5 grid squares across, and H is two grid squares high. This is determined by measuring how far horizontally and vertically the fragment extends in each view. This means that, starting at the bottom endpoint of the line and 3 squares to the left, 1.5 back, and 2 up is the top endpoint of fragment 15.

From this, basic mathematics can be used to find many useful dimensions about the fragment. For example, using Pythagorean's Theorem ($L^2=A^2+B^2+H^2$)L, the length of the fragment, can be determined. Furthermore, there are two angles associated with the fragment: the angle of the fragment relative to the "ground" below, and the angle relative to the "face," which are represented as $\theta$ and $\phi$, respectively. $\theta$ is useful in making the actual fragment, while $\phi$ is used to properly position the fragment on the base. These angles are both labeled on FIG. 6A. $\phi$ was chosen as relative to the A face, however, the B face can alternatively be chosen. Trigonometry can be used to find that $\theta=\sin^{-1}(H/L)$ and $\phi=\tan^{-1}(B/A)$. This is similar to three-dimensional spherical coordinates, which locates a point based on its distance from the origin (in this case, the bottom endpoint) and its angle relative to two different axes. This calculation can be mimicked for every fragment to create a table such as the one shown in FIG. 6B.

Of course, many fragments have a $\theta$ or $\phi$ value of 0 or 90 degrees. This occurs when A, B, or H is zero. In this case, the fragment is contained not in a cube, but on a flat rectangle, which is one of the sides of the original cube. To visualize this, look at FIG. 6A and imagine one of these values going to 0. One could go even further and look at fragments 5 or 19 in FIG. 4I, at which both angles are 0 or 90. Here the fragment goes along the edge of the cube, so the fragment is contained in a straight line. Nevertheless, the mathematics is the same.

With these cubes of the coordinate subsystem, the exact fragment positioning in the display has been determined. All that remains is to arrange the fragments on a base of some kind to resemble the three drawn viewpoints of the display: "work" from one side, "play" from another, and FIG. 5B from the top.

The coordinate subsystem can get complicated, because each fragment has been given its own "coordinate subsystem" relative to the bottom endpoint, and spherical coordinates are unfamiliar and awkward. This means that the overall mapping of the fragments has within it a subsystem of mappings. This coordinate subsystem was designed so that each object was considered a single item, and then the subsystem described the fragments in more detail. There are, however, other features that can be used for positioning.

Figures 6B, 7A:
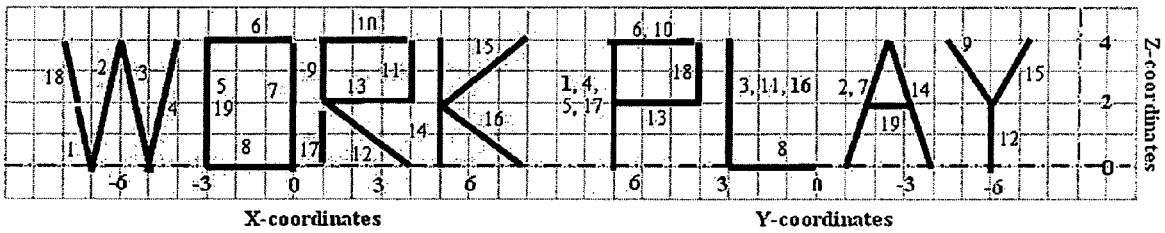

In another embodiment, the positioning can be achieved using a Cartesian system, which determines the two endpoints of each fragment. While the previous coordinate subsystem embodiment considered each fragment to be a "stick" of certain dimensions in a certain location, the Cartesian system considers each fragment to be a pair of coordinates in an XYZ coordinate system. The first step is to determine the origin of the display and labeling distances from this origin. For example, FIG. 7A shows the origin as 0 for the x, y, and z axes of the work-play display. The origin is creating an approximate center of the display. Just as there was an A and B in the coordinate subsystem method, this Cartesian system can have a first image along a first axis such as "work" along the x-axis, a second image along a second axis such as "play" along the y-axis, and a third axis for height of the first and second images such as the z-axis. Then each fragment is considered to be a pair of points in Cartesian space, one for each endpoint. Numbering can go from positive to negative so that both the first and second images are facing outwards. Notice that "play" in FIG. 7A goes from positive to negative in the numbering. For example, the coordinates for fragment 15 in FIG. 7A are (5, −6, 2) and (8, −7.5, 4). Similarly, fragment 4 has the coordinates (−5, 7, 0) and (−4, 7, 4).

Figure 7C:
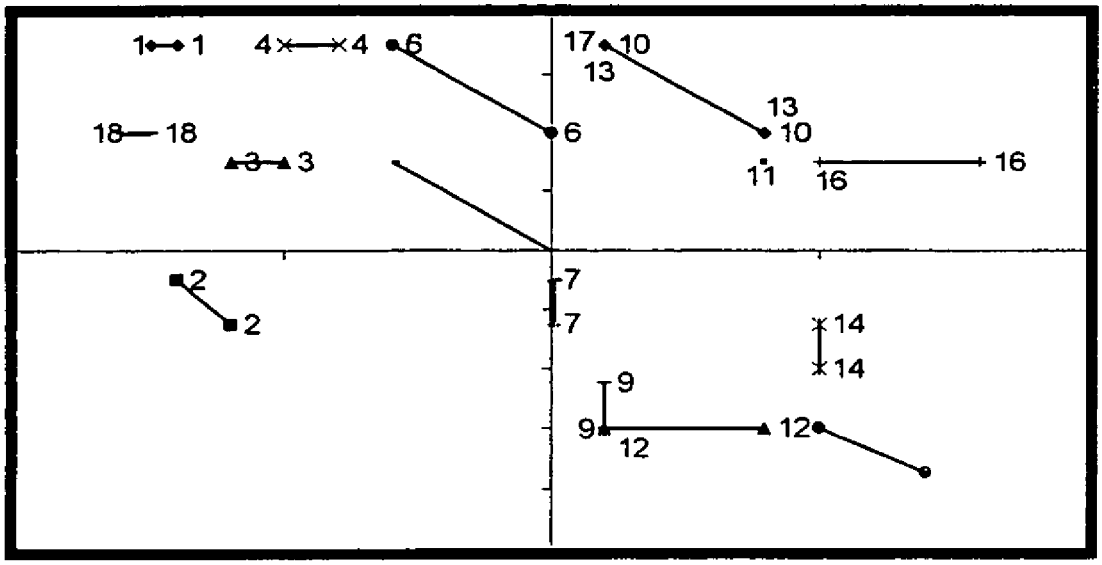

A table such as the one shown in FIG. 7B can be constructed as in the coordinate subsystem. Comparing the table in FIG. 7B to FIG. 7A, the fragments' coordinates match. Additionally, the same calculations can be made as in the coordinate subsystem, but in this case some are unnecessary. The Length, L, will need to be determined using $L^2=(X_2-X_1)^2+(Y_2-Y_1)^2+(Z_2-Z_1)^2$, where the fragment is represented by endpoints $(X_1, Y_1, Z_1)$ and $(X_2, Y_2, Z_2)$. To assist in construction, it is also helpful to calculate $\theta$, which is $\theta=\sin^{-1}((Z_2-Z_1)/L)$. Note that these two equations are almost exactly the same as those used in the coordinate subsystem method, but instead of using an absolute distance (A, B, or H) that is only relative to the fragment, the Cartesian system uses the difference of two universal values. As shown in FIG. 7B, the values perfectly match those of the previous method shown in FIG. 6B. Also, FIG. 7C shows a graph of the points on the XY plane that match with FIG. 5B. The only difference may be with the horizontal fragments, such as 6, 10, and 13. Because these fragments are horizontal, they can be in one of two positions, but both work correctly.

Using the Cartesian system, it is not necessary to calculate $\phi$. Instead, the fragment angle will position itself when the fragment is positioned according to the two endpoints at the correct location relative to the Cartesian system.

Figure 8A:
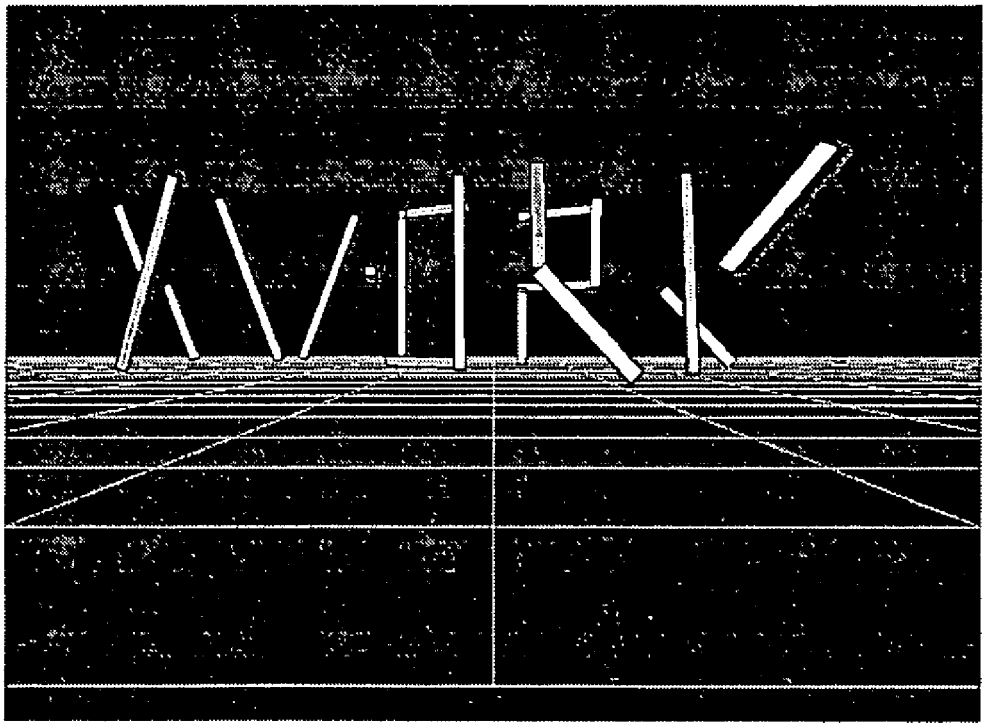

The display can optionally be designed further. The entire premise for this display is that the orthographic projections of the display reveal images, as can be seen in FIG. 2. In a real life situation, however, it may not be possible to view the display in this manner. For example, if the display were very small, then all of the parallel lines of the grid properly hit the eyes of the viewer, and the fragments align to form an image. If, however, the display were larger, then the lines do not all hit the viewer's eyes; the lines on either end pass the viewer on either side, so only the middle of the image aligns properly and the image appears incomplete. This concept can be easily seen in FIG. 8A where "work" doesn't align properly because not all the lines can hit the viewer's eyes. A smaller sized display, as in FIG. 9C, shows that it is much easier to see the image spelled out by the fragments. This change in size can mean two things; that the display needs to be of a small size, or the viewer needs to view the display from a greater distance. Either change has the same effect.

Figure 8B:
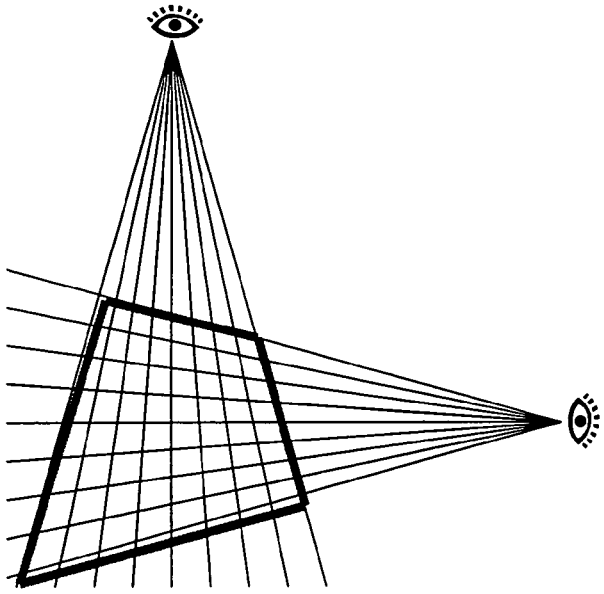

There are several solutions for this focal alignment issue. The first two solutions are simple: have relatively small displays or require the viewer to stand very farther away. However, there is another focal alignment method where the position of the fragments can be adjusted such as using an angled grid. An angled grid can be created so that all the lines hit the viewer's eyes, as shown in FIG. 8B. Notice that the grid is angled for both viewing directions, since both images must be adjusted for proper alignment.

Figure 8C:
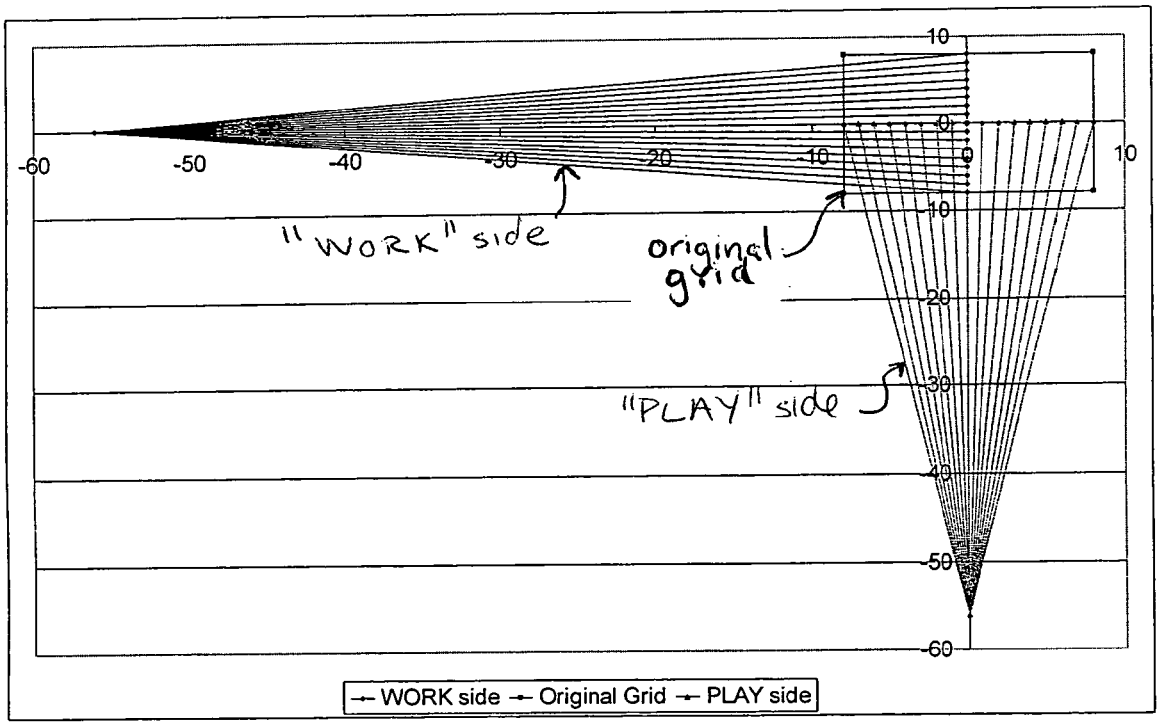
Figure 8D:
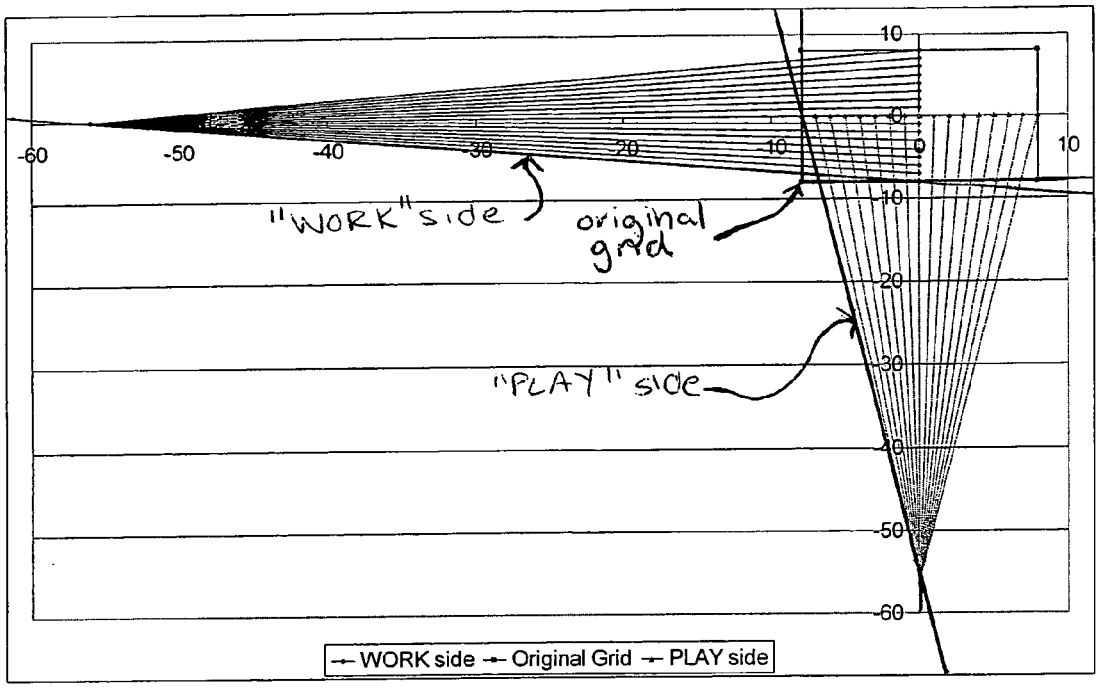

There are many ways to create such a grid; the simplest is to physically draw evenly spaced rays coming from the desired viewpoint. However, it can be done much more accurately if it is instead mathematically calculated. Simple geometry can be used for these calculations as shown in FIGS. 8C and 8D.

First, the size of the initial grid and the viewing locations must be determined. For example and convenience of numbers, the display begins at 16 inches by 16 inches and 8 inches tall. Thus, if every grid square in FIG. 7A is a 1 inch by 1 inch square, the dimensions will match appropriately. As shown in FIG. 8C, the original square is 16 by 16. The viewing location can be approximately four feet, or 48 inches, from either image of the display as shown.

For help in visualizing this procedure, a series of rays emanate from the viewing locations and intersect every inch along the X and Y axes. These rays can be used to calculate a new location for any point on the original grid such as moving the unadjusted point (−8, −8) shown in FIG. 8C to its "adjusted" location as shown in FIG. 8D. In this case, the two rays that intersect with those particular X and Y values are also shown in FIG. 8D. Notice that the intersection of the perpendicular lines represents the unadjusted points (in the bottom left corner of the box), and the intersection of rays represents the adjusted points.

Figure 8E:
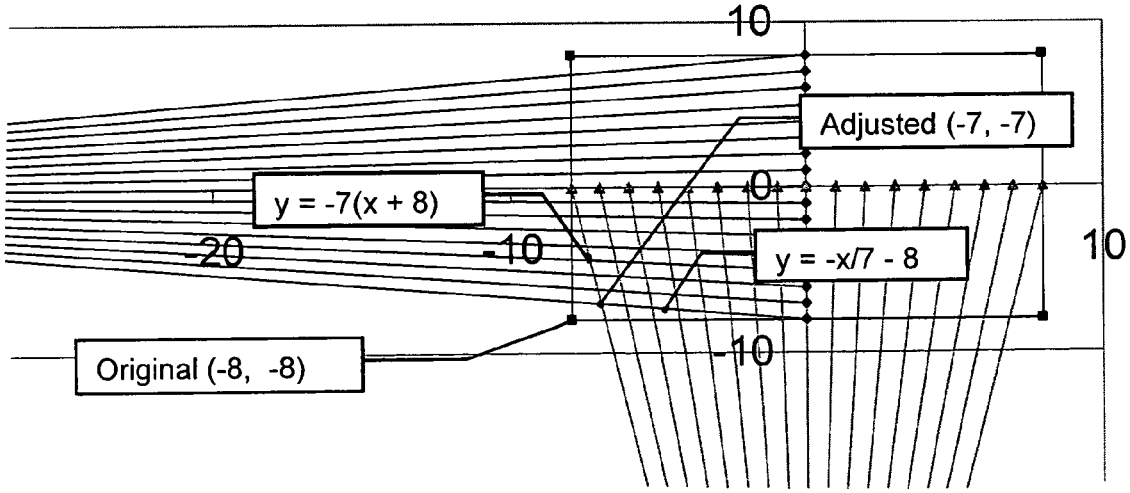

The adjusted positions of the fragments can be determined mathematically as the rays are simply lines, and intersection of the two lines can be found on a Cartesian plane. The steps of the calculations are described below and refer to FIG. 8E:

1. The viewing location or focal point coordinates are (−56, 0) and (0, −56) since the viewing location is 48" from the display and centered on the axis. These focal point coordinates provide the two points for each ray. The X and Y coordinates of the unadjusted point are {−8, −8}; thus, the rays that will intersect with the points at (0, −8) and (−8, 0), respectively.
2. Thus the equation $$m = \frac{y_2 - y_1}{x_2 - x_1}$$

is used to find the slope, m, for each line. Plugging this value of m and one of the two points back into the equation, provides a standard equation $(y-y')=m\times(x-x')$ for a line. Here, $m_1=-8/56=-1/7$ and $m_2=-7$, and the equations are $y-(-8)=(-1/7)\times(x-0)$ and $y-0=-7\times(x-(-8))$.

3. These equations can be simplified to $y=-x/7-8$ and $y=-7\times(x+8)$. These lines are labeled on FIG. 8E, which defined the locations of the two rays.
4. Since the point is at the intersection of both these lines, its values must satisfy both equations. If the values are set equal to each other—in this case, $-7\times(x+8)=-x/7-8$—and solve for x, the new x coordinate is found to be $x=-7$.
5. The x value is now calculated and can be plugged back into either line equation to find $y=-7$.
6. The new adjusted point can now be labeled (−7,−7). It is now know that any point that was previously located at (−8, −8) can be reassigned to (−7, −7).

These steps can be done for every point in FIG. 7B to provide the adjusted coordinates. Manually these calculations may be time consuming depending on the number of fragments for the display. However, a software or computer program such as MATLAB can perform these calculations. The program can perform the calculations automatically, given a desired distance from the display from both sides and the desired points that need to be adjusted. FIG. 8F shows an example grid of points and an overlay of the resulting adjustment. Notice that lines were drawn through these points, they are no longer parallel, but instead they all converge at the same two locations, just as required for the focal alignment. An example of a MATLAB code is shown in FIG. 8G.

Figure 8I:
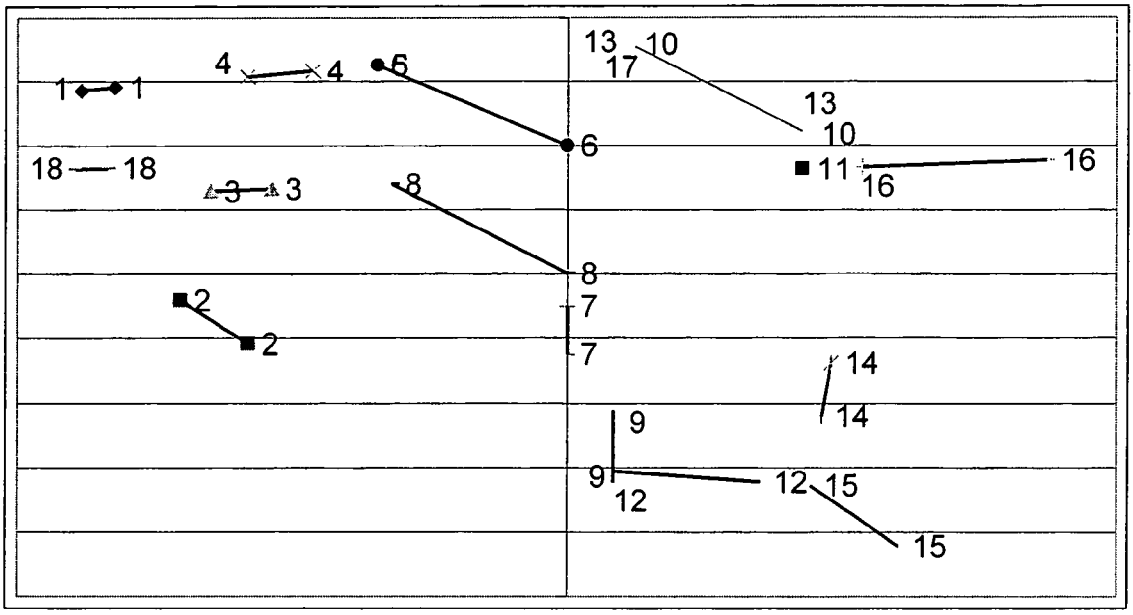

FIG. 8H is a table that provides the adjusted points of FIG. 7B. These points can then be used for the final plan of the work-play display. The original locations of the fragments are shown in FIG. 5B and the adjusted or focally aligned fragments are shown in FIG. 8I. Note the changes in fragment locations, especially how some points move significantly, while others barely change.

The fragments were adjusted using the XY plane or side-to-side focal alignment. However, if the image appears warped, there can also be adjustment of the Z plane or top-to-bottom focal alignment. If the warp is not significant or is acceptable, the focal alignment method outlined above can be used to adjust the points. It is also possible to make a display without this adjustment by manually adjusting the fragments. The fragments can still align properly, but the images as a whole are not distorted. This adjustment is not a mathematical concept, but a more subjective touch. The process can be easier when the height of the display is small relative to the widths, because less adjustment is necessary to begin with.

The invention is now ready for assembly. The fragments can be secured directly to a base or suspended above the base using support members. For example and not limitation, the fragments can be secured on support members that are disposed on a base. The base can be a surface suitable for placing the fragments and support members thereon. The base is shown in several of the examples as a horizontal board but is not limited thereto as other surfaces such as a floor, sidewalk, or other surface can be used as a base. Any fragments that are positioned directly on the base can be secured thereto using a fastening means such as but not limited to glue, adhesive, nails, tacks, bolts.

Other fragments can be positioned and suspended above the base using support members. The support member can comprise wire or other material that can support the weight of a fragment but does not distract from either of the images. For purposes of illustration and not limitation glass, plastic, ceramic, wire, strands or columns may be used. It is helpful if the support member is flexible although rigid support members can also be used. When wire is used as a support member, it needs to be relatively sturdy such as conventional 0.062" steel wire. The support members can be attached to the suspended fragments using conventional means including but not limited to adhesives, fasteners, a support member received in an aperture drilled in the fragment, as shown in FIG. 1C work-play display, and other attaching devices.

Figure 9A:
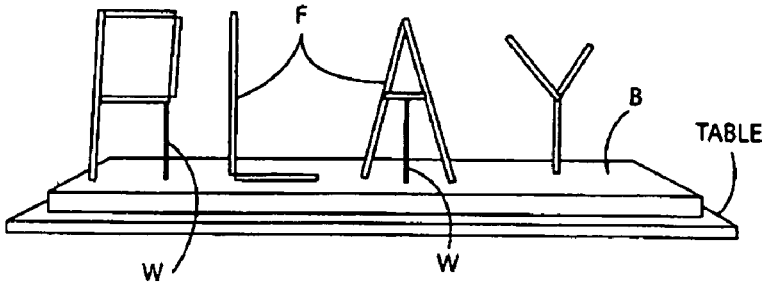
FIGS. 9A and 9B are side views of words "work" and "play" of the final work-play display.
Figure 9B:
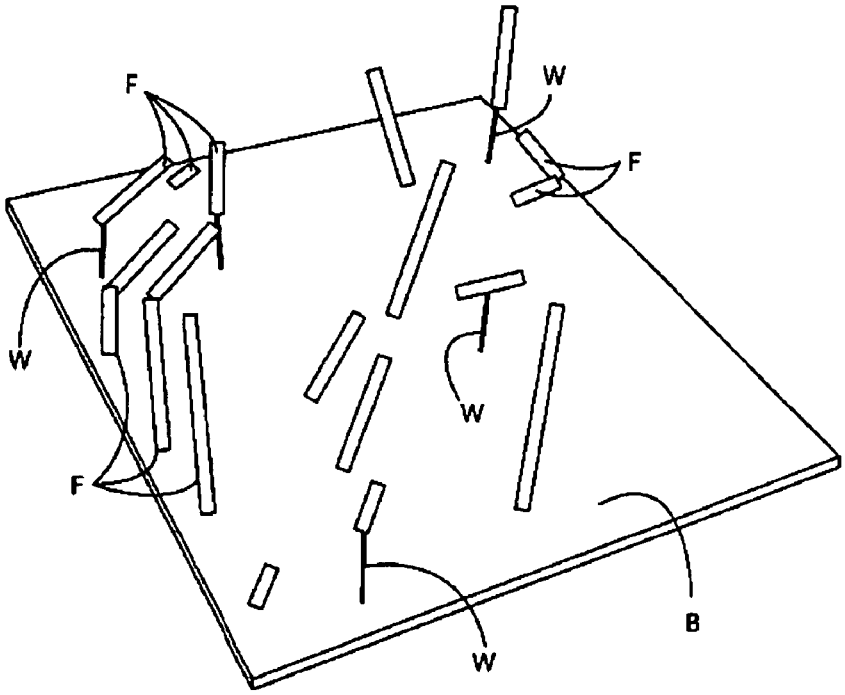
Figure 9C:
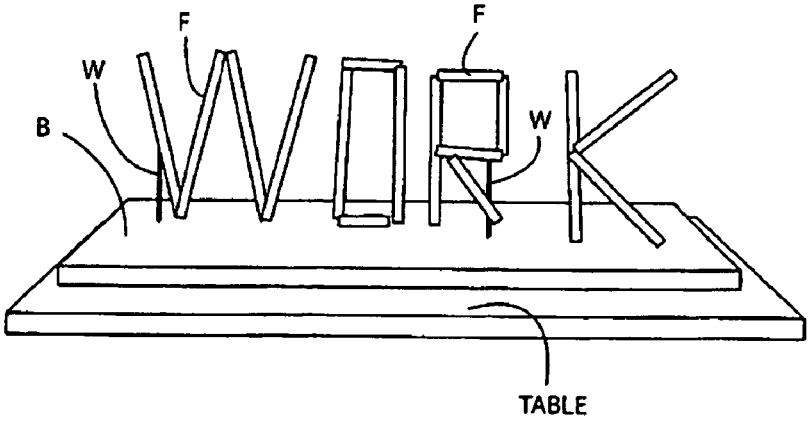
FIG. 9C is a perspective view of the final work-play display using a pegboard for the base, wire for the support members, and wood pieces for the fragments.

FIGS. 9A, 9B, 9C show an example of the assembled work-play display on a table that uses a flat board as a base B and wire support members W to support the wood fragments F. This method and type of display can be designed and assembled with limited resources because it can be built by hand using a few very simple tools. In addition, the base is very convenient to draw on, to make the proper grids and marks to put the fragments in the correct positions.

Figure 10A:
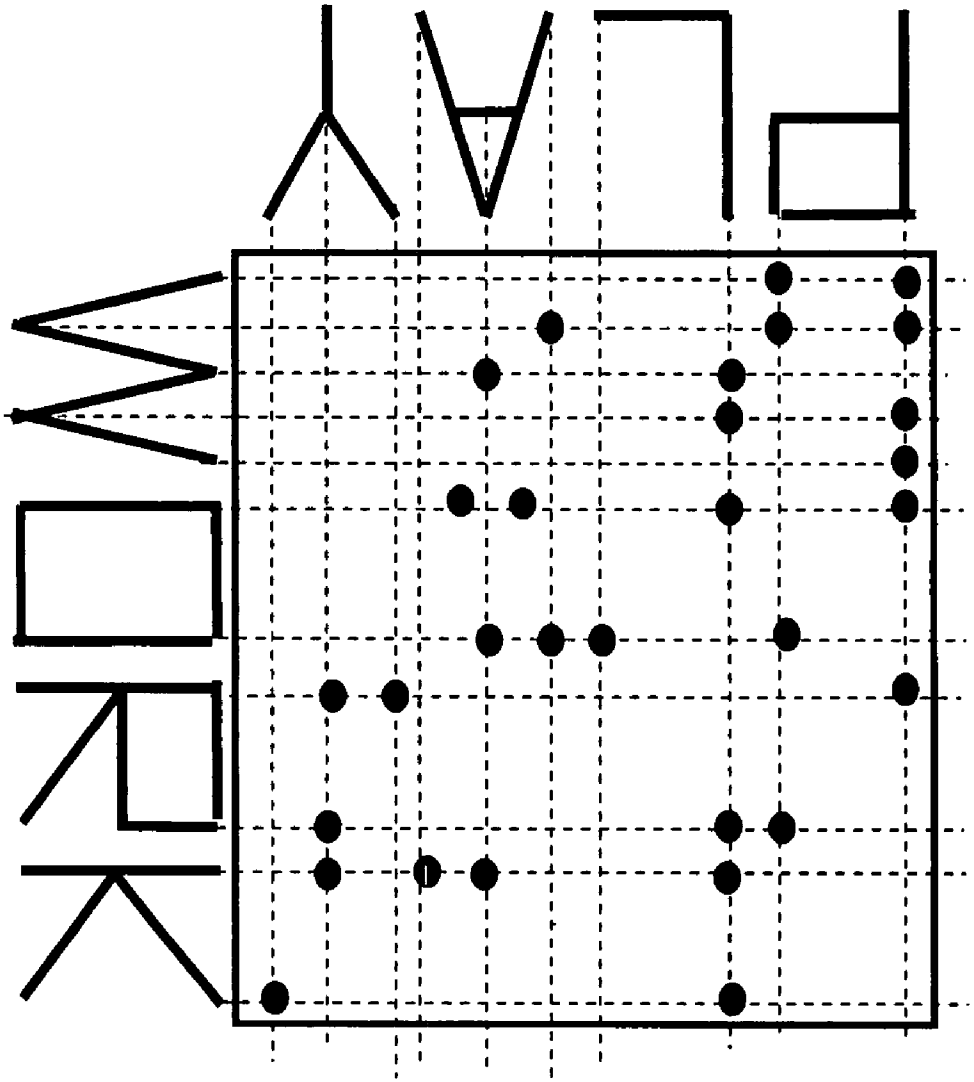
FIGS. 10A-10D illustrate the method of making the embodiment that uses suspended support members to support fragments in a display.
Figure 10B:
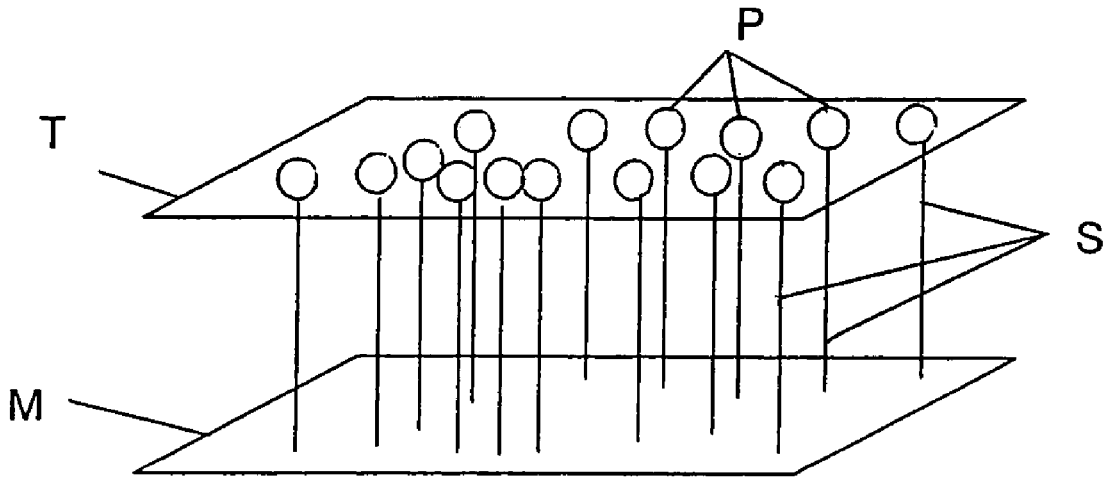
Figure 10C:
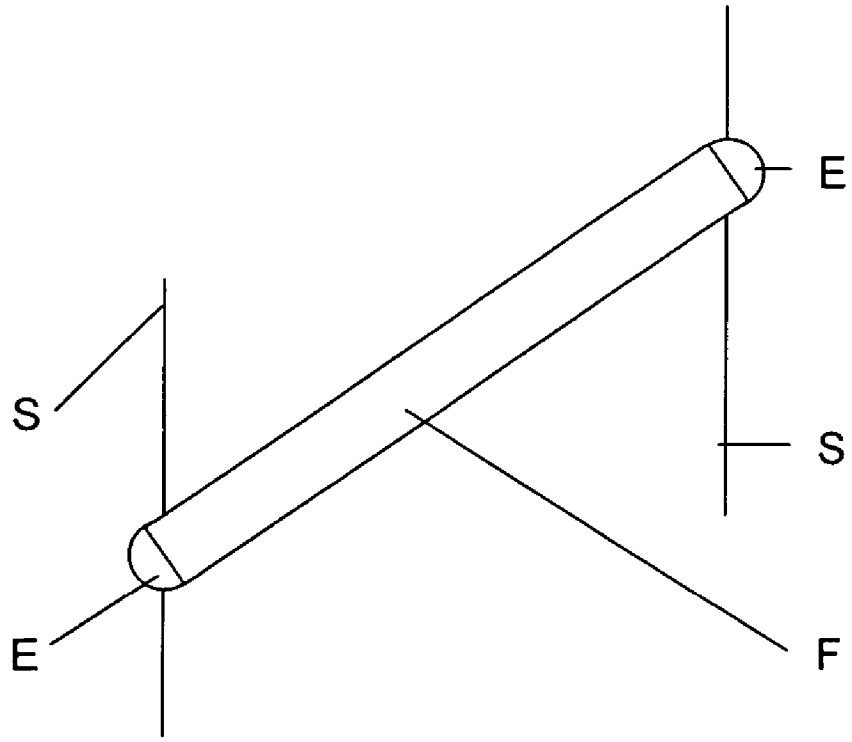
Figure 10D:
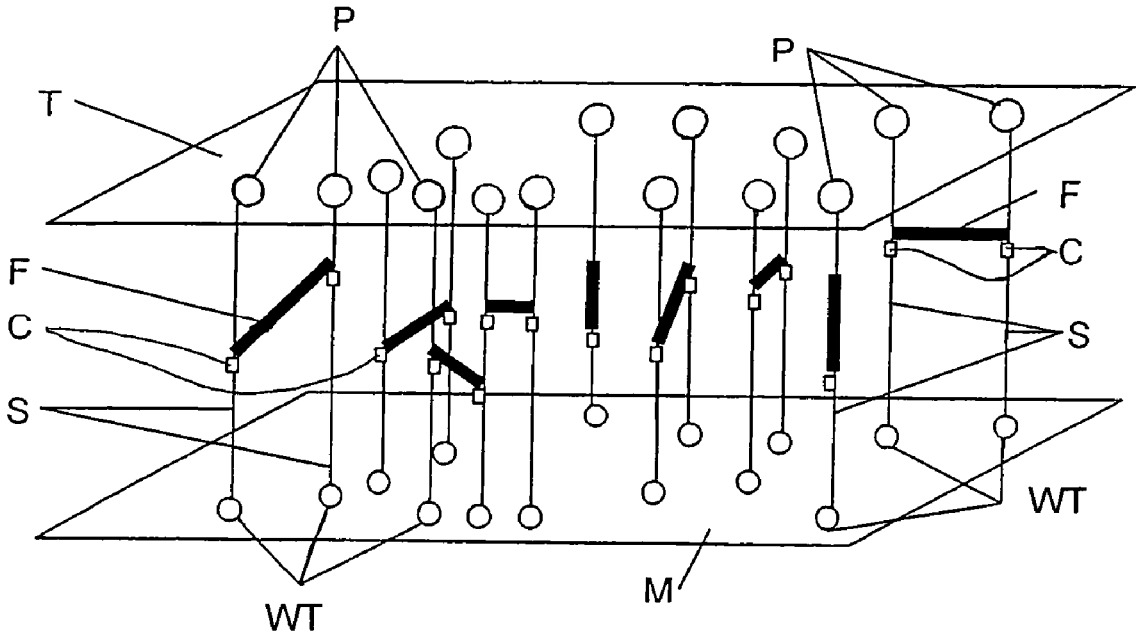

In still another embodiment, the display can be assembled such that the fragments are disposed on suspended support members. This method is similar to using the base method described above; however, the support members S are suspended from a top plate T, as shown in FIG. 10D. The suspended support members S can be constructed of an unobtrusively shaped material such as but not limited to strands or columns made of fiber, wire, glass, plastic, ceramic, or combinations thereof. An example of a suspended sculpture was assembled using a Plexiglas top plate, monofilament strands for the suspended support members, aluminum tubing for the fragments, and small rubber beads maintain the position of the fragments on the monofilament.

The suspended display can be designed using the Cartesian system or other method described above. FIG. 5B shows a top view of the work-play display example, which shows only the X and Y coordinates and ignores the height. FIG. 10A shows a similar diagram where the dots represent the endpoints of the fragments. To make the top plate of the display, the builder can take the dots of FIG. 10A and drill a plurality of openings P corresponding to the dot locations therein, see FIG. 10B. The suspended support members S can then be attached to the top plate T at the openings P by tying a knot at the opening P. The invention is not limited to using the openings in the plate for attaching the suspended support members thereto as the invention also envisions that other means for attaching the support members can be used such as but not limited to eyelets, adhesive, hooks, pegs, clips positioned at the dot locations.

However, flexible suspended support members S do not necessarily pass through the proper points in some situations: the wind can blow them the wrong way, the suspended support members can get tangled, and the suspended support member itself could have winding loops skew the images. To account for this, an identical bottom plate M can be used and is shown in 10B. The bottom plate M can have a plurality of openings that correspond to the top plate openings P for securing the suspended support members S thereto. Thus, the suspended support members S can be attached at the openings P in the top plate T and can also be attached to the corresponding openings in the bottom plate M. The suspended support members can now form vertical lines, and if the openings are done carefully, each of the suspended support members can pass exactly through at least one endpoint of each fragment F.

The top and bottom plates can be constructed of a material suitable for supporting and maintaining the position and weight of the support members and fragments thereon. The top and bottom plates are preferably made of a clear polycarbonate; however the invention is not limited thereto as the invention also envisions using ceilings, floors, furniture, bridges, trees, or other man-made or natural structures as a plate for the suspended embodiment.

The alignment of the openings in the top and bottom plates T, M to the XY coordinates or dots as shown in FIG. 10A can be achieved by transferring these XY coordinates to the plates. The XY coordinates in one embodiment can be drilled into the top and bottom plates T, M. A CNC mill with digital readout can be used to align the drill end perfectly to the desired coordinates. To ensure that the openings line up properly, the top and bottom plates T, M can be drilled at the same time by simply stacking one on top of the other.

After the top and bottom plates have been constructed with the corresponding openings, then the suspended support members can be attached to the top plate T. For example and not limitation, the suspended support members can each be a strand of monofilament that is secured to its respective openings P in the top plate T by tying a knot in each the strand. The bottom of the strands can be secured with a weight WT, shown in FIG. 10D, such as a conventional round split shot. The weight can be a removable weight that can be temporarily used to secure the suspended support member while positioning the fragments or can be used to secure the suspended support members to the bottom plate M. Split shot is easily fastened to and removed from strands using a pair of pliers, and is well-suited to the task of securing the support members; however, the invention also envisions that other forms of conventional weights can be used.

The display fragments can then be constructed and hung on the strands. The fragments can be constructed of any material suitable for displaying an image. Tubing or other hollow material is especially convenient in that there is no need to drill an opening all the way down the length of the fragment. For example and not limitation, the fragments can be constructed out of aluminum tubing that has been cut off a ¼" longer than the calculated dimensions dictated. This extra quarter inch provides an extra ⅛" on each end; otherwise the far edges of the fragments just barely touch the suspended support members, and there is no way to attach them. An aperture in both ends of the fragment can be used to secure the fragment to the suspended support member. The aperture can be drilled in the center of the extra ⅛" on each of the ends. Being centered is not necessary as the aperture can be placed at nearly any location along the fragment; however, it can be more visually appealing to have the aperture on the ends of the fragment. Furthermore, the ends E of the fragments F can be rounded as shown in FIG. 10C for aesthetic reasons.

To position the fragments in the display, the supporting structure can be built free of fragments using two plates. The top plate T can hold the bottom plate M by a plurality of the support members S, and removable weights can be clamped to the bottom ends of the suspended support members S. Then by following the diagrams and plans, each fragment F can be movably attached to the support member S at no particular height, just so that the fragment is attached to the support member. For example, monofilament strands can be threaded through apertures in an end of an aluminum tubing fragment as shown in FIG. 10C. The angle of each fragment can be adjusted by adjusting one end and not the other, as long as the openings drilled in either end of the fragment are large enough for some variation in angle.

The fragments can be movably attached to the support members using a securing means that can be adjusted. For example and not limitation small, rubber beads that are preferably clear can be used such as but not limited to earring clutches, which can provide good friction on the monofilament to hold the fragments securely, but still be moved freely on the lines in adjusting.

Once all of the fragments are attached to the suspended support members, the Z coordinate comes into play. Each fragment can be slid along the suspended support members until reaching its proper height relative to the other fragments. For example, measurements from the base can be used to determine a "base height" and adjusted therefrom. FIG. 10D shows a display comprising weights WT and fragments F on the suspended support members S; earring clutches C for maintaining the position of the fragments F; openings P for attaching the suspended support members S to the top plate T; and bottom plate M.

Although the display can be constructed, as described above, the invention is not limited to these embodiments. The invention also envisions using various materials and methods to achieve a display having a first image visible when the display is viewed in one direction, a second image visible when the display is viewed in a different direction, and neither the first image nor the second image visible when the display is viewed in other directions. Additional examples of these various materials and methods are described below and are offered in order to more fully illustrate the invention but are not to be construed as limiting the scope thereof.

An example is a rapid printing display and method that can be used to bypass building the display; there are many methods available where a CAD drawing of an object can be "printed" directly. A rapid prototyping machine can produce a perfect plastic display in one solid fragment. It may be necessary to add wires and a base to the CAD drawing; otherwise it may simply print out unconnected fragments.

In another example, the display can be made using three dimensional laser etching. This is a process by which a three dimensional image is etched into the center of a crystal block using lasers. There are many advantages to this crystal etching in that no labor is needed to construct the displays so the crystal etched display can be mass produced. Also, a crystal display can be constructed of a block having fragments therein. In addition, smaller sizes can be easily attained using this technology as it can be challenging to make displays in those sizes.

In still another example the display can be made using small shaped image fragments such as square or round beads. A display made of these materials can be more flexible and can have more fragments, which can provide a look similar to a swarm of insects.

Figure 11A:
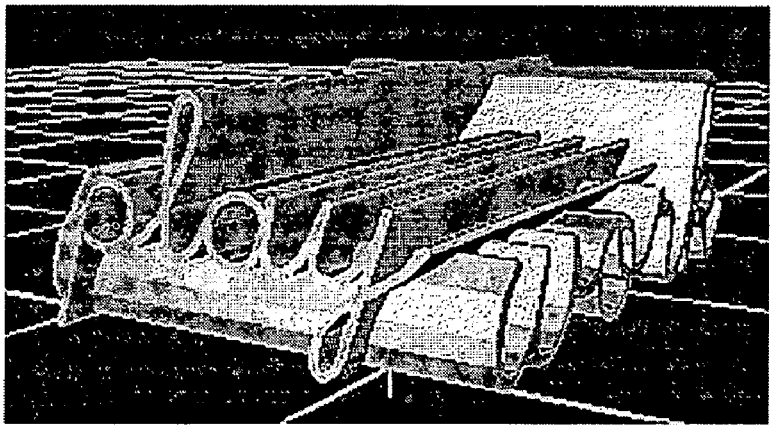
FIG. 11A is a perspective view of curvilinear images projected into a three dimensional space to be occupied by the display.
Figure 11B:
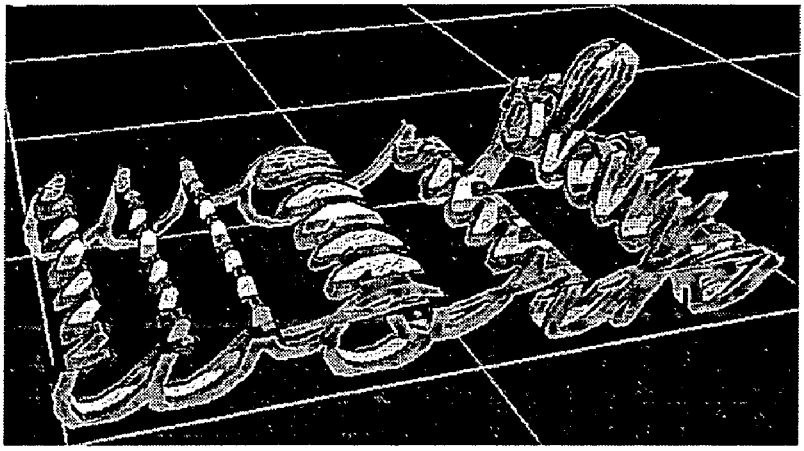
FIG. 11B is a perspective view of a bent apparatus to form a display of the two curvilinear images.

Another example provides an apparatus bent into position for displaying two curvilinear images as shown in FIGS. 11A and 11B. The display can comprise a bendable apparatus that can be a metal rod that is bent into shape using tools but is not limited thereto as other materials such as wire or fiber can be used. This embodiment can provide two images that are both vertically and horizontally continuous and is especially useful for curved letters and shapes that connect.

This bendable embodiment can involve a method of making a display comprising projecting the first image and the second image into a three dimensional space to be occupied by the display so that the first image and the second image intersect in the space as shown in FIG. 11A. Then portions can be removed from the projecting first and second images, as shown in FIG. 11B, until the minimum number of portions remains to form the first and second images in a display having the first and second images are visible when the display is viewed in one direction, the second image visible when the display is viewed in a different direction, and neither the first image nor the second image visible when the display is viewed in other directions.

This bendable embodiment can further include fragmenting the first image and second image into a plurality of first image fragments and second image fragments and positioning these fragments so that the images will appear fragmented.

In another embodiment of the display, a light source can be provided to impinge light on the display. The light can also be used to project the images as shadows behind the fragments. The shadows can become a part of the display. The light source can also be placed at the two viewing directions so that the light can reveal the two images from fragmentations having light reflective materials.

In still another embodiment of the display, color can be used to display the two images. The first and second images can have different colors from one viewing direction and also within the same image. The fragments can be of a shape such that only one "face" of the fragment is visible from one side, and another face is visible from the other. Then the faces can be colored as needed.

Figure 12:
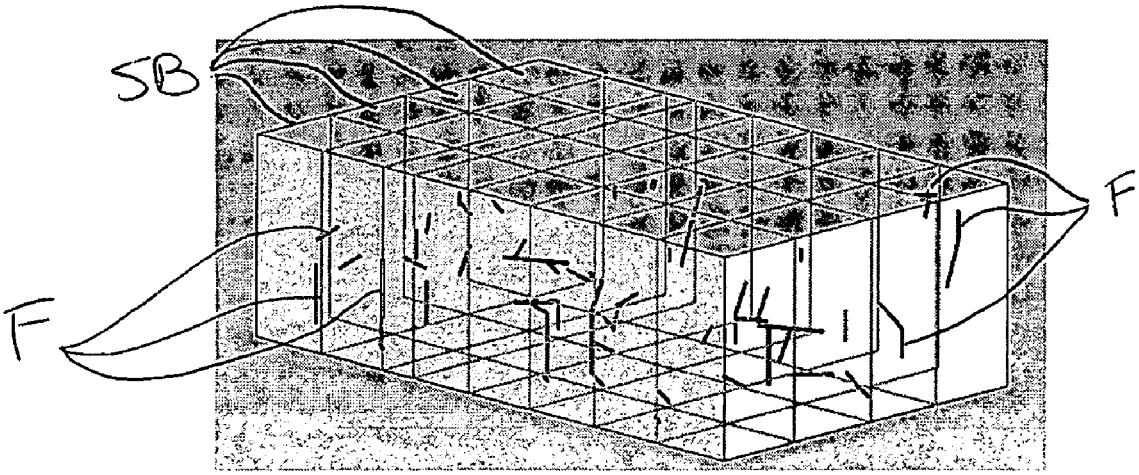
FIG. 12 is a perspective view of fragments disposed on a plurality of support bodies.

In another embodiment the fragments can reside on one or more support bodies so as to be visible. For example, the first and second image fragments can be disposed on or in a support body made of a transparent type of material such as but not limited to glass and plastic. The support body can be solid or hollow and constructed of any shape such as but not limited to rounded or polygonal shapes. For example, each support body can comprise a solid, transparent cube similar to that shown in FIG. 6A having an image fragment therein. The invention also envisions that part of a hollow support body can protrude therefrom to support an image fragment therein. The support body can contain all of the fragments for the display such that the support body with the fragments is the complete display. The invention envisions that a plurality of fragments or only one fragment F can be disposed on a support body so as to require a plurality of support bodies SB to complete the display. The support bodies SB themselves can be stacked, positioned side-by-side, shown in FIG. 12, or otherwise positioned to form the display.

In another embodiment the fragments can be made using several colored cubes to form a specific outline, the colors can line up to reveal a large rectangular shape, or "canvas," upon which an elaborate image can be seen. For such a display, the colored cubes or pigment can be embedded in clear plastic, so that the color variation can be aligned to form the two images. The effect can be similar to the color variation seen in pointillistic paintings.

The invention also envisions a kit for making a three dimensional display comprising a plurality of fragments of a first image fragments of a first image, a plurality of second image fragments of a second image, a plurality of support members on which the first and second image fragments are positioned. For example and not limitation, referring to FIG. 1C, the kit can comprise precut image fragments F, support wires W, and a base B such as the pegboard base described above. Instructions can be provided for arranging the first and second image fragments until the display is formed having the first image is visible when the display is viewed in one direction, the second image is visible when the display is viewed in a different direction, and neither the first image nor the second image is visible when the display is viewed in other directions. The instructions can be written or a software program that can assist in the design of the display.

The invention also envisions that the kit can be used to design the display in its entirety. The first and second image fragments can be modifiable so that the user can modify them for the display. For example, the fragments can be modified by cutting the fragments or coloring the fragments to form the two selected images. Instructions and/or software program can be provided to make the calculations and a plan for modification of the fragments. The program can print out length and cutting templates, and directions for building the display.

Another embodiment of the invention advantageously provides a method of displaying an advertisement comprising providing an advertising display having a first and second image where the first image is visible when the display is viewed in one direction, the second image is visible when the display is viewed in a different direction, and neither the first image nor the second image visible when the display is viewed in other directions, and positioning the advertising display at a location where the public can view the display in a plurality of directions that include said one direction and said different direction. For example, referring to FIG. 1C, the display can be positioned at a location in a building or outside of a building where individuals of the public can walk around the display until they see the "angel" and "devil" words. The first and second images can each comprise a word, shape, symbol, figure, alphanumeric image, slogan, name, corporate name, logo, trademark, service mark, URL, domain name, or combinations thereof.

This method can be used for large scale public displays such as in a park or museum. The public can see the display where the images are an advertisement as the public moves from one viewing location to the second viewing location.

The invention also envisions that more than two images are viewed from more than two viewing directions such as but not limited to three images viewed from three directions.

It is to be understood that the invention has been described with respect to certain specific embodiments thereof for purposes of illustration and not limitation. The present invention envisions that modifications, changes, and the like can be made therein without departing from the spirit and scope of the invention as set forth in the following claims.

I claim:

1. A method of making a display, comprising fragmenting a first image into a plurality of individual first image fragments, fragmenting a different second image into a plurality of individual second image fragments, and positioning the image fragments at spaced apart locations and at orientations in a three dimensional space to form a display wherein when viewed from a first preselected direction relative to the display at least a plurality of the image fragments appear to be connected in a first configuration that forms the first image, and wherein when viewed from a second preselected direction relative to the display at least a plurality of the image fragments appear to be connected in a second configuration that forms the second image, and wherein when viewed from directions relative to the display that are other than the first or second preselected directions the image fragments appear to be disconnected and spaced apart from each other such that neither the first image nor the second image is visible.

2. The method of claim 1 further including positioning an individual first image fragment to form part of the second image.

3. The method of claim 1 further including positioning an individual second image fragment to form part of the first image.

4. The method of claim 1 further including positioning an individual first image fragment so as to hide behind an individual second image fragment.

5. The method of claim 1 further including positioning an individual second image fragment so as to hide behind an individual first image fragment.

6. The method of claim 1 wherein the positioning step includes determining the location of each individual image fragment in the display, determining the length and orientation angle of each individual image fragment in the display according to the location, length, and angle so as to be spaced apart from and out of contact with adjacent image fragments.

7. The method of claim 1 wherein the positioning step includes using a coordinate subsystem.

8. The method of claim 7 wherein the coordinate subsystem is a spherical coordinate subsystem.

9. The method of claim 7 wherein the coordinate subsystem is based on cubes that collectively form the three dimensional space of the display.

10. The method of claim 1 wherein the positioning step includes using a Cartesian system.

11. The method of claim 10 wherein the Cartesian system has the first image along a first axis and the second image along a second axis with the first image and the second image having the same height along the respective first axis and second axis.

12. The method of claim 11 wherein the Cartesian system has a third axis for the height of first and second images.

13. The method of claim 1 further including positioning one or more image fragments on one or more support bodies.

14. The method of claim 13 further comprising positioning the support bodies to form the display.

15. The method of claim 1 further comprising adjusting the position of one or more of the individual image fragments to improve focal alignment.

16. The method of claim 1 further comprising securing the image fragments on support members disposed on a base.

17. The method of claim 1 further comprising disposing the image fragments on suspended support strands.

18. A method of making a display, comprising projecting a two dimensional first image and a two dimensional second image into a three dimensional space to be occupied by the display so that the two dimensional first and second images intersect in the space, and removing fragments from the projecting two dimensional first and second images until fewer fragments remain and the remaining fragments form a display wherein when viewed from a first preselected direction relative to the display at least a plurality of the remaining fragments appear to be connected to each other in a configuration that forms the first two dimensional image, and wherein when viewed from a second preselected direction relative to the display at least a plurality of the remaining fragments appear to be connected to each other in a configuration that forms the second two dimensional image, and wherein when viewed from directions relative to the display other than the first or second preselected directions the remaining fragments do not appear to form the two dimensional first or second image.

19. The method of claim 18 further including fragmenting the first image into a plurality of first image fragments, and fragmenting the second image into a plurality of second image fragments.

20. The method of claim 19 further including positioning the first image fragments and second image fragments so as to be spaced apart from and out of contact with next adjacent image fragments.

21. A method of making a display, comprising positioning a plurality of image fragments in spaced apart locations and in orientations within a three dimensional space wherein when viewed from a first preselected direction relative to the display at least a plurality of the image fragments appear to be connected to each other in a first configuration that forms a first image, and wherein when viewed from a second preselected direction relative to the display at least a plurality of the image fragments appear to be connected to each other in a second configuration that forms a different second image, and wherein when viewed from directions relative to the display other than the first or second preselected directions the image fragments appear to be disconnected and spaced apart from each other.

22. The method of claim 21 further comprising removing image fragments from the projecting first and second image until a minimum number of spaced apart and out of contact fragments remains to form the first and second images.

23. A display, comprising a plurality of first image fragments of a first image and a plurality of second image fragments of a second image wherein the image fragments are disposed at such spaced apart locations out of contact with one another in a three dimensional space that the image fragments form the first image visible when the display is viewed in one direction, the second image visible when the display is viewed in a different direction, and neither the first image nor the second image visible when the display is viewed in other directions, and further comprising one or more support members for positioning the first and second image fragments in the display wherein the one or more support members comprise support wires disposed on a base, suspended support strands, or a cube.

24. The display of claim 23 wherein the first image comprises a word, shape, symbol, figure, alphanumeric image, slogan, name, corporate name, logo, trademark, service mark, URL, domain name, or combinations thereof.

25. The display of claim 23 wherein the second image comprises a word, shape, symbol, figure, alphanumeric image, slogan, name, corporate name, logo, trademark, service mark, URL, domain name, or combinations thereof.

26. The method of claim 18 wherein the step of removing fragments further comprises removing fragments until a minimum number of fragments form the first and second two dimensional versions of the three dimensional first and second images.

27. The display of claim 23 wherein the image fragments are formed within a cube.

28. The display of claim 23 wherein an individual first image fragment forms part of the second image.

29. The display of claim 23 wherein an individual second image fragment forms part of the first image.

30. The display of claim 23 wherein an individual first image fragment is hidden behind an individual second image fragment.

31. The display of claim 23 wherein an individual second image fragment is hidden behind an individual first image fragment.

32. A display, comprising a plurality of first image fragments of a first image and a plurality of second image fragments of a second image wherein the image fragments are disposed at such spaced apart locations out of contact with one another in a three dimensional space that the image fragments form the first image visible when the display is viewed in one direction, the second image visible when the display is viewed in a different direction, and neither the first image nor the second image visible when the display is viewed in other directions, and further comprising a light source for impinging light on the display.

33. The display of claim 32 wherein one or more first image fragments reside on one or more support bodies so as to be visible and one or more second image fragments reside on one or more support bodies so as to be visible.

34. The display of claim 33 wherein the one or more support bodies are positioned to form the display.

35. The display of claim 33 wherein the support bodies are stacked with the image fragments out of contact with one another to form the display.

36. The display of claim 34 wherein the support bodies are positioned side-by-side to form the display.

37. A kit for making a three dimensional display comprising a plurality of first image fragments of a first image, a plurality of second image fragments of a second image, a plurality of support members on which the first and second image fragments are positioned, and instructions for arranging the first and second image fragments spaced apart from and out of contact with one another in three dimensional space until the display is formed, wherein when viewed from a first preselected direction relative to the display at least a plurality of the image fragments appear to be connected to each other in a first configuration that forms the first image, and wherein when viewed from a second preselected direction relative to the display at least a plurality of the image fragments appear to be connected to each other in a second configuration that forms a different second image, and wherein when viewed from directions relative to the display other than the first or second preselected directions the image fragments appear to be disconnected and spaced apart from each other.

38. A method of displaying an advertisement comprising providing an advertising display having a first image and second image formed by image fragments spaced apart from and out of contact with one another in three dimensional space, wherein when viewed from a first preselected direction relative to the display at least a plurality of the image fragments appear to be connected to each other in a first configuration that forms the first image, wherein when viewed from a second preselected direction relative to the display at least a plurality of the image fragments appear to be connected to each other in a second configuration that forms the second image, and wherein when viewed from directions relative to the display other than the first or second preselected directions the image fragments appear to be disconnected and spaced apart from each other.

39. The method of claim 38 wherein the first image comprises a word, shape, symbol, figure, alphanumeric image, slogan, name, corporate name, logo, trademark, service mark, URL, domain name, or combinations thereof.

40. The method of claim 38 wherein the second image comprises a word, shape, symbol, figure, alphanumeric image, slogan, name, corporate name, logo, trademark, service mark, URL, domain name, or combinations thereof.

41. The method of claim 1 wherein the image fragments each comprise a straight line fragment of a word.

42. A method of making a display, comprising fragmenting a first word image and a second word image into a plurality of individual fragments and positioning the image fragments at spaced apart locations with the image fragments out of contact with one another and at orientations in a three dimensional space to form a display having the image fragments forming the first word image visible when the display is viewed from a first preselected direction relative to the display and wherein at least a plurality of the image fragments appear to be connected to each other, the second word image visible when the display is viewed from a different second preselected direction relative to the display and wherein at least a plurality of the image fragments appear to be connected to each other, and neither the first word image nor the second word image visible when the display is viewed from directions relative to the display that are other than the first or second preselected directions and wherein the image fragments appear to be disconnected and spaced apart from each other.

43. A display, comprising a plurality of image fragments of a first word image and of a second word image wherein the image fragments are disposed as such spaced apart locations out of contact with one another in a three dimensional space that the image fragments form the first word image visible when the display is viewed from a first preselected direction relative to the display and wherein at least a plurality of the image fragments appear to be connected to each other, the second word image visible when the display is viewed from a different second preselected direction relative to the display and wherein at least a plurality of the image fragments appear to be connected to each other, and neither the first word image nor the second word image visible when the display is viewed from other directions relative to the display that are other than the first or second preselected directions and wherein the image fragments appear to be disconnected and spaced apart from each other.

44. A method of making a display, comprising fragmenting a first image into a plurality of individual first image fragments, fragmenting a second image into a plurality of individual second image fragments, and positioning the image fragments at space apart locations and at orientations in a three dimensional space using a coordinate subsystem based on cubes that collectively form said three dimensional space so as to form a display having the image fragments spaced apart from next adjacent image fragments so as to form the first image visible when the display is viewed in one direction, the second image visible when the display is viewed in a different direction, and neither the first image nor the second image visible when the display is viewed in other directions.

45. A method of making a display, comprising fragmenting a first image into a plurality of individual first image fragments, fragmenting a second image into a plurality of individual second image fragments, and suspending the image fragments on support strands at space apart locations and at orientations in a three dimensional space so as to form a display having the image fragments spaced apart from next adjacent image fragments so as to form the first image visible when the display is viewed in one direction, the second image visible when the display is viewed in a different direction, and neither the first image nor the second image visible when the display is viewed in other directions.

* * * * *